US012698635B2

(12) United States Patent
Patterson

(10) Patent No.: US 12,698,635 B2
(45) Date of Patent: Aug. 4, 2026

(54) RECESSED TRIM INSTALLATION SYSTEM

(71) Applicant: ARM Systems, LLC, Peachtree Corners, GA (US)

(72) Inventor: Dan Patterson, Powder Springs, GA (US)

(73) Assignee: ARM Systems, LLC, Peachtree Corners, GA (US)

( * ) Notice: Subject to any disclaimer, the term of this patent is extended or adjusted under 35 U.S.C. 154(b) by 160 days.

(21) Appl. No.: 18/610,410

(22) Filed: Mar. 20, 2024

(65) Prior Publication Data

US 2025/0129618 A1 Apr. 24, 2025

Related U.S. Application Data

(60) Provisional application No. 63/592,297, filed on Oct. 23, 2023.

(51) Int. Cl.
*E04F 19/04* (2006.01)

(52) U.S. Cl.
CPC ..... *E04F 19/0486* (2013.01); *E04F 19/0468* (2013.01); *E04F 19/049* (2013.01); *E04F 19/0495* (2013.01); *E04F 2019/0454* (2013.01)

(58) Field of Classification Search
CPC ..... E04F 19/02; E04F 19/04; E04F 19/0436; E04F 19/0486; E04F 19/0495; E04F 2019/0404; E04F 2019/0413; E04F 2019/0422; E04F 2019/0427; E04F 2013/061; E04F 2013/063; E04D 13/1415
See application file for complete search history.

(56) References Cited

U.S. PATENT DOCUMENTS 3,464,177 A * 9/1969 Amato ..... E04F 19/0495 52/718.04
6,131,348 A * 10/2000 Dunham ..... E04F 13/06 52/287.1

(Continued)

FOREIGN PATENT DOCUMENTS

AU 2016100362 A4 * 5/2016 ..... E04F 19/0486
GB 2312221 A * 10/1997 ..... E04F 19/0436
KR 20140057766 A * 5/2014 ..... B63B 29/02

OTHER PUBLICATIONS

Trim and Reveal Systems | Drywall Profiles | Fry Reglet https://fryreglet.com/drywall-trims-reveals-moldings/.

(Continued)

*Primary Examiner* — Kyle J. Walraed-Sullivan
(74) *Attorney, Agent, or Firm* — Meunier Carlin & Curfman LLC

(57) ABSTRACT

A reglet may include a first base extending in a first plane. A reglet may include a first backbone integrally formed with and extending from the first base in a second plane that is substantially perpendicular to the first plane. A reglet may include a first mud flange integrally formed with and extending from the first backbone in a third plane that is substantially perpendicular to the second plane and substantially parallel to and spaced apart from the first plane. A reglet may include a second side forming an angle of between 0 and 180 degrees with the first side of the reglet, wherein the first side and the second side of the reglet are integrally formed to meet at a corner.

14 Claims, 37 Drawing Sheets

(56) References Cited

U.S. PATENT DOCUMENTS

| | | | | |
|---|---|---|---|---|
| 6,354,057 | B1 * | 3/2002 | Ploplis | B29C 66/1162 52/287.1 |
| 9,970,201 | B2 * | 5/2018 | Morozov | E04F 19/064 |
| 2007/0119107 | A1 * | 5/2007 | Shaw | E04D 13/15 52/287.1 |
| 2009/0092790 | A1 * | 4/2009 | Carnes | E04F 19/04 264/177.17 |
| 2009/0235612 | A1 * | 9/2009 | Shaw | E04D 13/15 52/748.1 |
| 2016/0289974 | A1 * | 10/2016 | Smythe | E04F 19/028 |
| 2019/0186156 | A1 * | 6/2019 | Bertovic | E04F 19/04 |
| 2023/0272625 | A1 * | 8/2023 | Mast | E04F 19/0459 52/288.1 |

OTHER PUBLICATIONS

Flush Base | Drywall Reveal by Fry Reglet https://fryreglet.com/flush-base/.
Flush Trim Mount [Lite]—Fittes https://fittes.ca/products/flush-trim-mount-lite.
Reveal & Shadow Beads for Drywall | Trim-Tex https://www.trim-tex.com/products/reveal-shadow-beads.
One Piece Base | Tektrim https://www.tektrim.com/one-piece-base/.
¾" Bullnose Kerf Metal Trim—Phillips Manufacturing (phillipsmfg.com) https://www.phillipsmfg.com/34-bullnose-kerf/.
Kerf Door Jambs—What Are They and When are They Used?—AFT Construction https://www.aftconstruction.com/blog/kerf-door-jambs.
Drywall Kerfed Bead for Doorways & Window Frames | Trim-Tex https://www.trim-tex.com/products/%C2%BE-bullnose-kerfed-bead.
EzyJamb® Frameless Steel Door Frames—EZ Concept US https://ezconcept.com/products/ezyjamb/.
Block frames—AGS Systems | flush doors and skirting boards (ags-systems.info) https://www.ags-systems.info/en/flush-door/block-frames/.
Online Store: 92" SnapBoard Coronado Baseboards (12) with Clips (m-rite.com) https://m-rite.com/baseboards-12-12.
Buy Removable Baseboards & Molding (m-rite.com) https://m-rite.com/gallery.
How to Install Flush Base Board—Modern Trim Detail—YouTube. Posted Apr. 8, 2016. On-line at: https://www.youtube.com/watch?v=Bcuf66RPlv0.
Recessed Baseboard walk through after Mud Setting the Reveal Bead (youtube.com) Posted Feb. 7, 2016. On-line at: https://www.youtube.com/watch?v=QD8e2xOrOck.
Modern Trim—How To—YouTube. Posted Feb. 10, 2017. On-line at: https://www.youtube.com/watch?app=desktop&v=p5xj6XpHkrg.

* cited by examiner

DETAIL A
GROOVE & GUIDELINE PROFILE
SCALE 4 : 1

DETAIL B
UNDERGROOVE PROFILE
SCALE 4 : 1

DETAIL C
BREAKAWAY MUD FLANGE GROOVE
SCALE 4 : 1

BACK-TOP ISOMETRIC VIEW
SCALE 1 / 2

DETAIL D
2 STAGE INSIDE CORNER
BREAK-TAB-TO-FIT SYSTEM
SCALE 4 : 1

FRONT-UNDER ISOMETRIC VIEW
SCALE 1 : 2

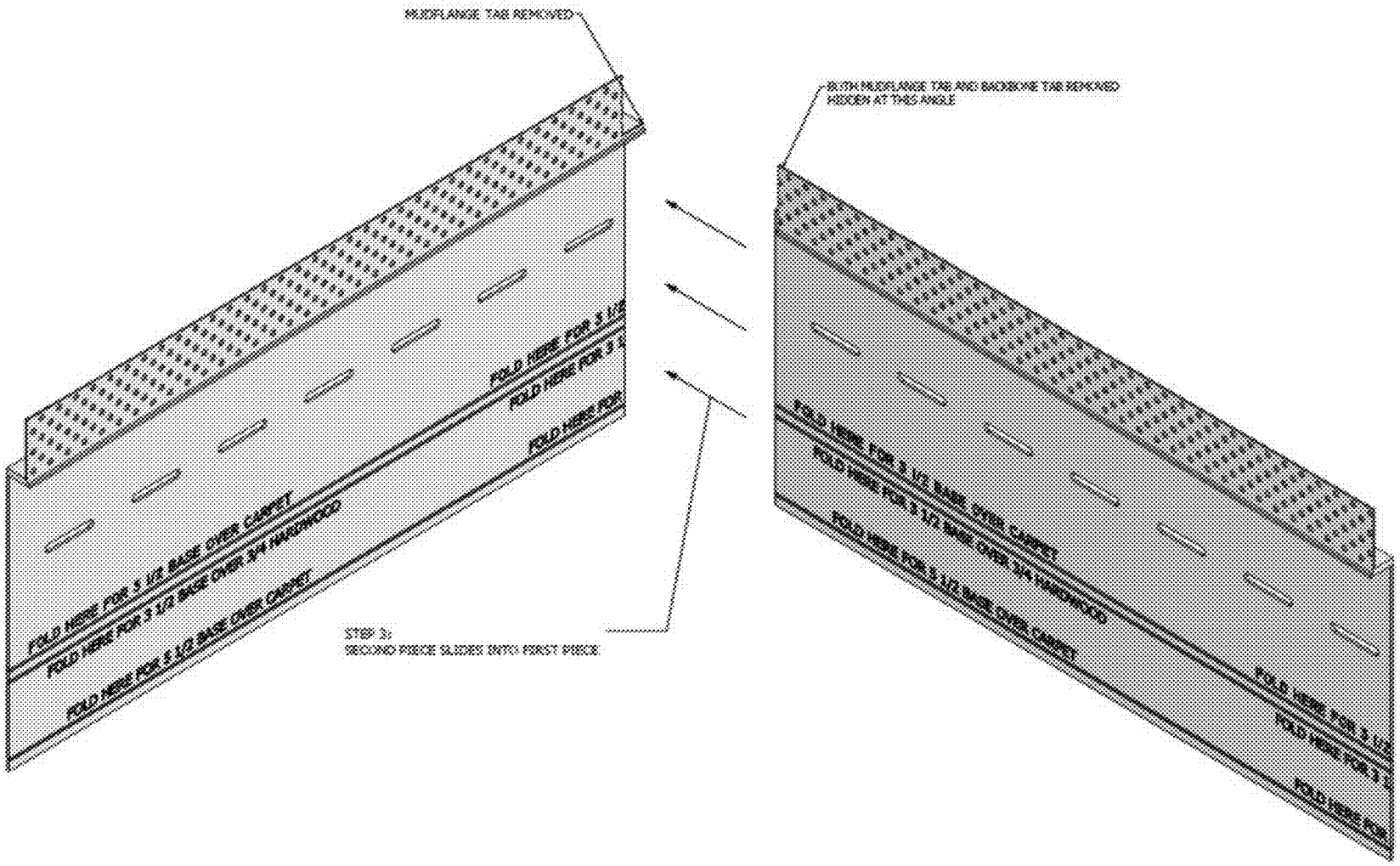
BOTH FLANGE TAB AND BACKING TAB REMOVED
HIDDEN AT THIS AREA
FLOOR BEAM FOR 3 1/2" BEAM OVER 3" FLANGE

DETAIL E
BREAKAWAY GROOVE FROM BOTTOM
BACKSIDE OF CORNER
SCALE 2 : 1

DETAIL B
GUIDELINES
SCALE 2 : 1

TOP VIEW
SCALE 1.25 : 1

DETAIL E
BREAKAWAY GROOVE FROM BOTTOM
BACKSIDE OF CORNER
SCALE 2 : 1

TOP VIEW
SCALE 1.25 : 1

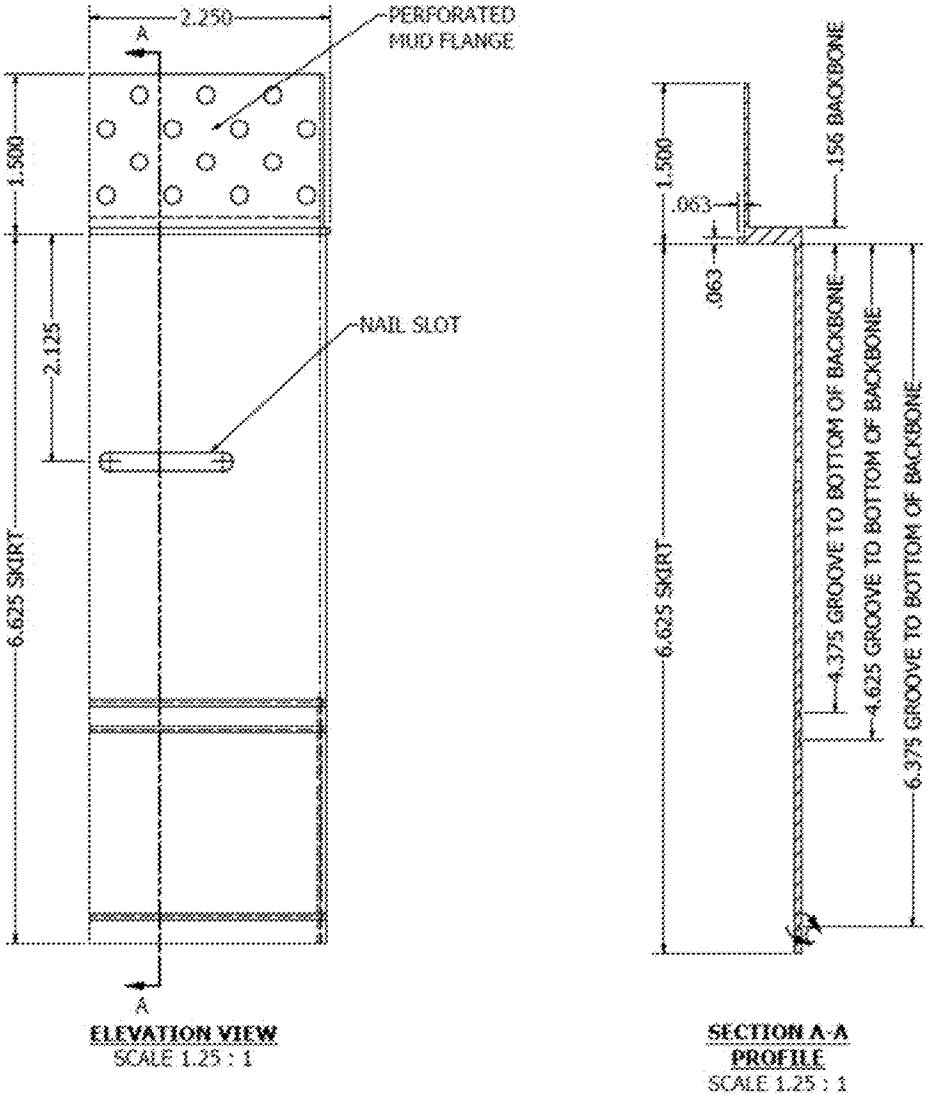
FIG. 58
FIG. 59
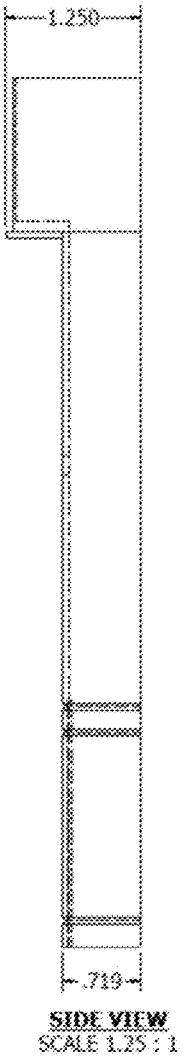
FIG. 60

SECTION A-A
DOORJAMB FLANGE
SCALE 2/1

DETAIL B
TENSIONING TAB FROM TOP
SCALE 4/1

DETAIL C
TENSIONING TAB FROM SIDE
SCALE 2/1

SECTION A-A
SQUARE CORNER INSET BASE FROM TOP
SCALE 2/1

SECTION A-A
SCALE 2/1

DETAIL B1
COPE TAB THICKNESS
SCALE 2 : 1

DETAIL B2
TOP-DOWN VIEW OF COPE TAB
SCALE 2/1

TOP
SCALE 1 : 1

SIDE
SCALE 1 : 1

SECTION A-A
SCALE 1 : 1

BACK
SCALE 1 : 1

BACK SIDE
SCALE 1 : 1

FRONT SIDE
SCALE 1 : 1

SIDE
SCALE 1 : 1

SECTION A-A
SCALE 1 : 1

TOP
SCALE 1 : 1

BACK
SCALE 1 : 1

BACK SIDE
SCALE 1 : 1

TOP
SCALE 1 : 1

RECESSED TRIM INSTALLATION SYSTEM

CROSS-REFERENCE TO RELATED APPLICATIONS

This application is claims priority to U.S. Provisional Patent Application No. 63/592,297, filed Oct. 23, 2023, which is incorporated herein by reference in its entirety.

BACKGROUND

The present disclosure relates generally to recessed trim and related installation systems.

Typical trim arrangements are installed "on top of", or exterior to, an existing drywall surface. For example, typical trim arrangements are installed on a drywall plane, which includes the exterior surface of the drywall (e.g., where the trim abuts and protrudes out from the drywall plane). In contrast, inset trim refers to a type of trim or molding that is installed such that the exterior surface of the trim is in the same plane as the drywall plane or recessed inward relative to the drywall plane. For example, the trim may be set into a recess underneath a drywall panel to align the exterior planes of each of the drywall panel and the trim. Instead of being mounted such that the trim and the adjacent drywall surface are in separate, spaced apart planes, inset trim is embedded within a specially created space that allows the exterior surface of the trim and the adjacent exterior surface of the drywall to be in the same plane or inward of the drywall plane, providing a unique aesthetic. A gap reveal trim system is a method used in architecture and interior design to create deliberate gaps, or reveals, between adjacent surfaces, materials, or components. For example, a gap may exist between the edges of an inset trim piece and the adjacent drywall surface. These gaps are intentional and can serve aesthetic, functional, or design purposes, contributing to the overall look and feel of a space.

However, none of these installation systems or methods can provide repeatable and accurate spacing and alignment, especially around corners and at the surface discontinuities, such as at door jambs. Therefore, a need exists for an inset trim installation system compatible with corners and other discontinuities.

SUMMARY

One implementation of the present disclosure is a reglet for forming an inset baseboard system at a corner, the reglet including a first side and a second side. The first side includes a first base extending in a first plane; a first backbone integrally formed with and extending from the first base in a second plane that is substantially perpendicular to the first plane; and a first mud flange integrally formed with and extending from the first backbone in a third plane that is substantially perpendicular to the second plane and substantially parallel to and spaced apart from the first plane. The second side forms an angle of between 0 and 180 degrees with the first side of the reglet. The first side and the second side of the reglet are integrally formed to meet at a corner.

In some implementations, the second side includes a slotted doorjamb flange extending from a top end to a bottom end of the reglet in a fourth plane that is substantially perpendicular to each of the first plane and the second plane such that the first base and the slotted doorjamb flange intersect at a substantially right angle.

In some implementations, the corner is a rounded corner and a curved portion having a radius of curvature is formed between the first mud flange the second mud flange.

In some implementations, the slotted doorjamb flange includes a tensioning tab extending from a back surface of the slotted doorjamb flange with an angle configured to abut a surface of a doorjamb to hold the reglet in place.

In some implementations, the second side includes: a second base extending in a fourth plane; a second backbone integrally formed with and extending from the second base in the second plane; and a second mud flange integrally formed with and extending from the second backbone in a fifth plane that is substantially perpendicular to the second plane and substantially parallel to and spaced apart from the fourth plane.

In some implementations, the first plane is orthogonal to the fourth plane, and the third plane is orthogonal to the fourth plane.

In some implementations, the corner is a rounded corner.

In some implementations, the corner is a sharp corner forming a corner edge between the first side and the second side of the reglet.

In some implementations, the first base defines a plurality of nail slots that are spaced apart from a bottom edge of the first base.

In some implementations, the first base defines a plurality of fold grooves on a back surface of the first base, the plurality of fold grooves being parallel to and spaced apart from a bottom edge of the first base.

In some implementations, the first mud flange defines a plurality of perforations configured to facilitate adherence of a joint compound therethrough.

In some implementations, the first backbone further includes a screed lip extending out from the first mud flange in a direction away from the first and third planes.

In some implementations, the reglet further includes at least one breakaway tab formed by a portion of the first mud flange on a lateral edge of the reglet, the at least one breakaway tab being removable from the reglet to accommodate a second reglet installed adjacent to the reglet.

In some implementations, an inset baseboard system is disclosed, the system including: the reglet; a drywall panel; and a baseboard. A front surface of the baseboard is disposed in the third plane, and a top edge of the baseboard is spaced apart from a bottom surface of the first backbone to define a gap therebetween. A bottom edge of the drywall panel is disposed between a back surface of the first mud flange and a top surface of the first backbone.

According to another implementation of the present disclosure, a reglet for forming an inset doorjamb system is disclosed, the reglet including: a base extending in a first plane; a backbone integrally formed with and extending from the base in a second plane that is substantially perpendicular to the first plane; and a mud flange integrally formed with and extending from the backbone in a third plane that is substantially perpendicular to the second plane and substantially parallel to and spaced apart from the first plane. A back surface of the mud flange and a first surface of the backbone together define a first cavity configured to accept a drywall panel. A second surface of the backbone opposite of the first surface of the backbone and a front surface of the base together define a second cavity configured to accept a doorjamb.

In some implementations, the reglet further includes a slotted doorjamb flange integrally formed with and extending from the base on a side of the base opposite from the backbone, the slotted doorjamb flange extending in a fourth plane that is substantially perpendicular to the first plane and substantially parallel to and spaced apart from the second plane.

In some implementations, the base defines a plurality of nail slots spaced apart from a bottom edge of the base.

In some implementations, the base defines a plurality of fold grooves on a back surface of the base, the plurality of fold grooves are parallel to and spaced apart from a bottom edge of the base.

In some implementations, the mud flange defines a plurality of perforations configured to facilitate adherence of a joint compound therethrough.

In some implementations, the backbone further includes a screed lip extending out from the mud flange in a direction away from the first and third planes.

According to another implementation of the present disclosure, a clip-on baseboard system is disclosed, the system including a mounting bracket and a baseboard. The mounting bracket includes a base including a back surface and a front surface; a central installation hole defined by the base; a first clip member extending from a first edge of the front surface; and a second clip member extending from a second edge of the front surface, the second edge being opposite and spaced apart from the first edge. A first longitudinal axis of the first clip member and a second longitudinal axis of the second clip member are parallel to each other. The baseboard includes a body including a front surface and a back surface; a first pair of arms extending from a first edge of the back surface of the baseboard to define a first cavity; and a second pair of arms extending from a second edge of the back surface to define a second cavity, the second edge of the back surface being opposite and spaced apart from the first edge of the back surface. A third longitudinal axis of the first pair of arms and a fourth longitudinal axis of the second pair of arms extend substantially parallel to each other. The baseboard is configured to be installed on the mounting bracket such that the first pair of arms receive the first clip member into the first cavity and the second pair of arms receive the second clip member into the second cavity.

In some implementations, the base of the mounting bracket further includes at least one tab extending out from the front surface of the base of the mounting bracket, wherein the at least one tab is configured to align with a slot defined in a base member of a reglet during installation.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF THE DRAWINGS

FIGS. 14-17 show the installation of two straight baseboard reglets of FIG. 1.

FIG. 58 shows a side view of the corner baseboard reglet of FIG. 55.

FIG. 59 shows a cross section along line AA of FIG. 58.

FIG. 60 shows another side view of the corner baseboard reglet of FIG. 55.

Figure 1:
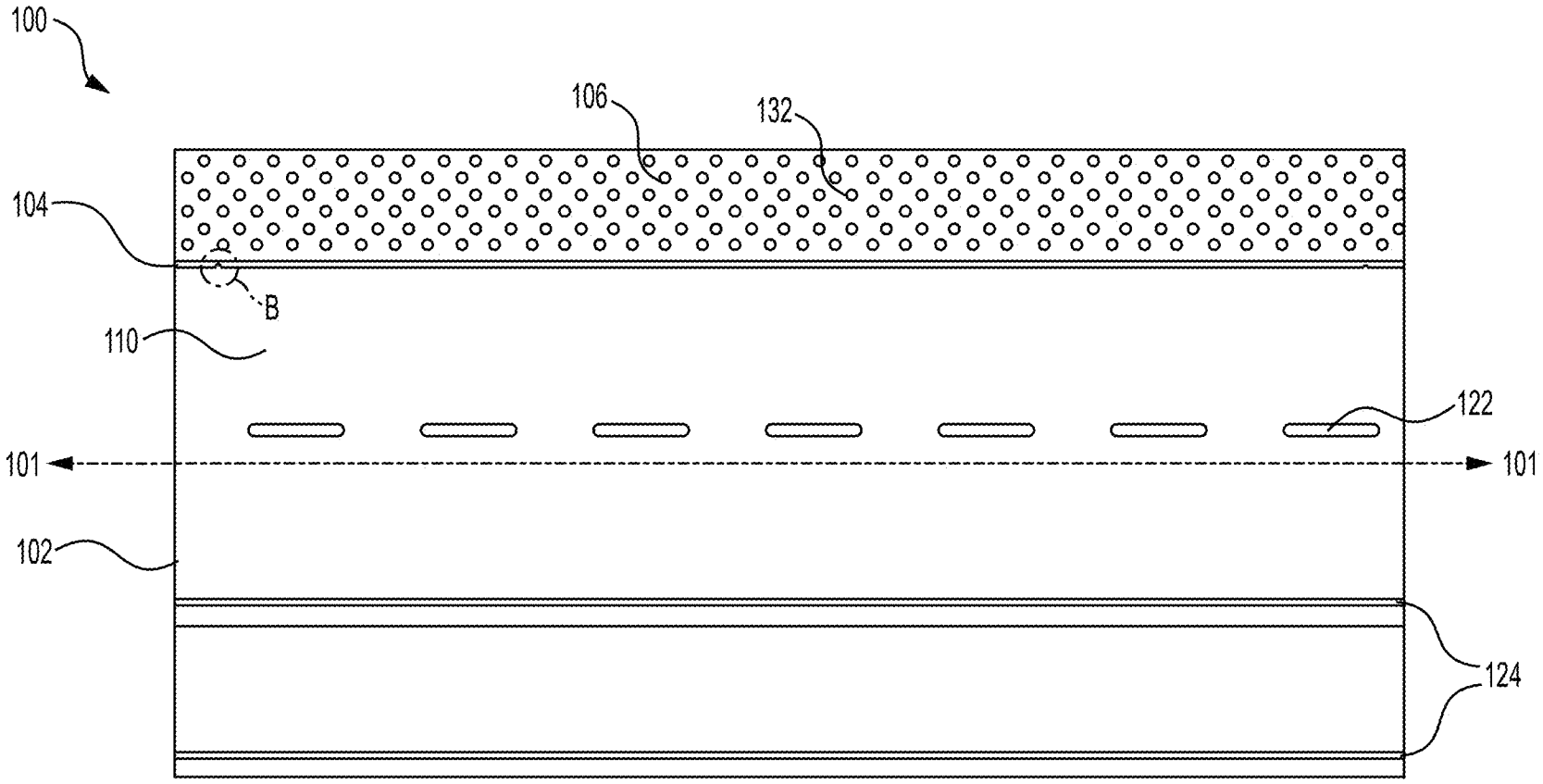
FIG. 1 shows a front view of a straight baseboard reglet, according to one implementation.

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

In this disclosure, the term "reglet" refers to a narrow strip of material comprising metal, plastic (e.g., Polyvinyl Chloride (PVC), polystyrene, polyethylene, etc.), or other rigid or semi-rigid materials shaped to align and guide the coupled trim and drywall relative to a wall.

In this disclosure, the term "trim" refers to material (such as wood, stone, or vinyl) used in the finish of a building, especially around wall openings, thresholds, and surface discontinuities.

In this disclosure, the terms "inset" or "recessed" refer to a first element (e.g., trim) being disposed within a cavity or space of another element (e.g., a wall) that allows the first element and adjacent surface to be in the same plane as, or inward from a plane of, the second element (e.g., to form a continuous surface therebetween).

In this disclosure, the term "flush" refers to one or more elements lying in the same plane or substantially the same plane.

In this disclosure, the terms "gap", "reveal", "gap reveal", or "shadow bead" refers to architectural elements having a discontinuity or a recessed cavity defined by two surfaces or edges that are spaced apart.

In this disclosure, the term "bullnose" refers to a rounded corner.

In this disclosure, the term "vertical" refers to a line, surface, or direction that is substantially, but not necessarily perfectly, aligned with the gravity vector.

In this disclosure, the term "horizontal" refers to a line, surface, or direction that is substantially, but not necessarily perfectly, perpendicular to the gravity vector.

In this disclosure, the figures shown and described may have a specific orientation (e.g., left-facing or right-facing) with respect to a door, wall, or opening. However, the reverse or opposite implementation of the same figure (e.g., right-facing or left-facing) is contemplated by this disclosure.

Disclosed herein are systems, methods, and devices facilitating the installation of inset or recessed trim, such as bullnose trim. Referring generally to the figures, systems, methods, and devices for recessed, flush, and/or gap reveal trim (e.g., baseboard or doorjamb trim) are shown, according to various implementations. The systems, methods, and devices of this disclosure include reglets for coupling drywall and trim together in a recessed, flush, and/or gap reveal system, according to some implementations.

Traditional recessed, flush, or gap reveal trim systems provide for linear (or "straight run") trim installation. However, existing systems fail to account for discontinuities in the wall, such as corners or door jambs. Existing systems either (i) allow both the trim and the drywall to meet at a sharp corner, (ii) allow the trim to meet at a sharp corner while the drywall includes a bullnose corner finish, or (iii) insert shims to approximate a rounded corner for the trim. Each of these existing solutions fails to provide a comprehensive, repeatable, and efficient system for installing recessed trim systems adjacent to discontinuities. The systems, methods, and devices of this disclosure have solved this problem as described in the below example solutions.

Straight Baseboard Reglet

FIGS. 1-18 provide various views of an example baseboard reglet 100 for coupling straight inset baseboards to a wall. FIGS. 1-10 include front views, isometric views, side views, and detail views of the baseboard reglet, including several details of a breakaway tab.

The straight baseboard reglet 100 includes a base 102, a backbone 104, and a mud flange 106. Each of the base 102, the backbone 104, and the mud flange 106 are formed (e.g., extruded or bent from a flat panel) from a vinyl plastic material (e.g., poly (vinyl chloride) (PVC) or other similar materials used in building and construction). Each of the base 102, the backbone 104, and the mud flange 106 are coupled to each other at substantially right angles to form a stairstep-like shape. That is, the base 102 and the mud flange 106 lie in parallel planes spaced apart from each other and are coupled together via the backbone 104, which is substantially perpendicular to each of the base 102 and the mud flange 106.

Figure 3:
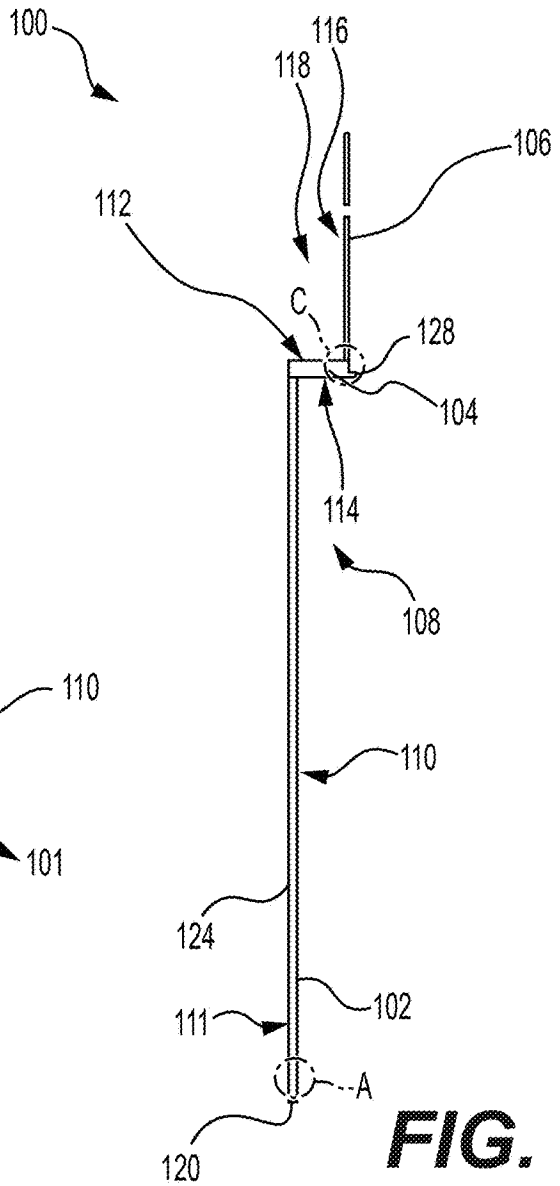
FIG. 3 shows a side view of the straight baseboard reglet of FIG. 1.
Figure 2:
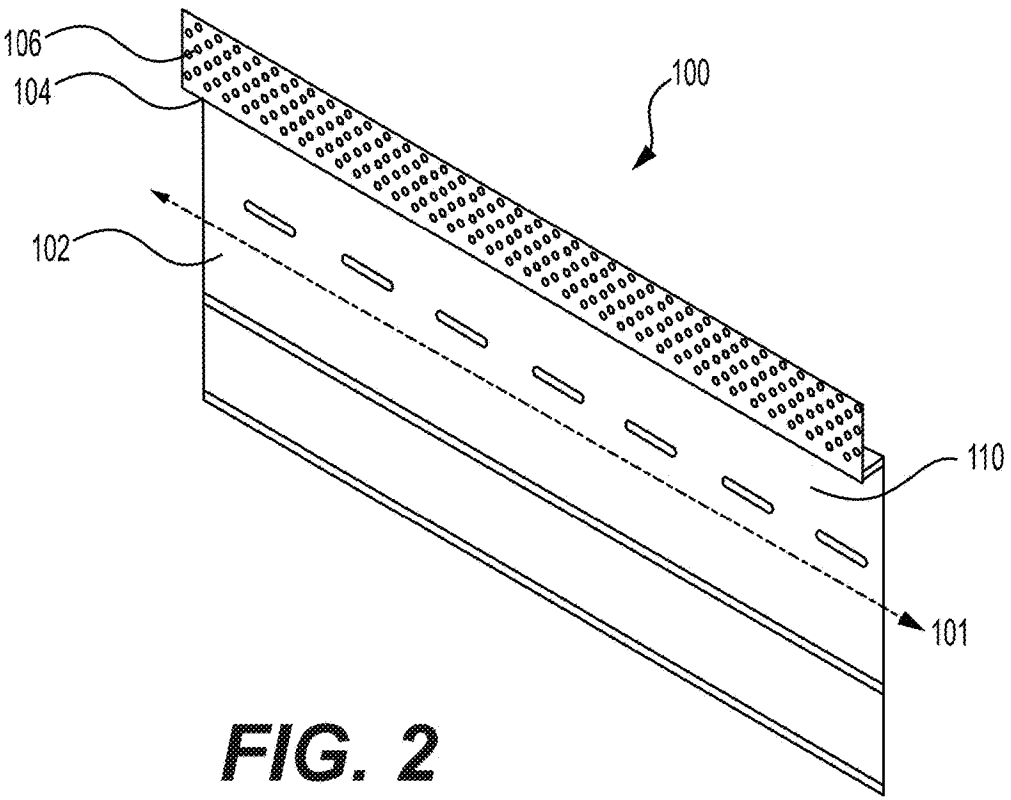
FIG. 2 shows a front isometric view of the straight baseboard reglet of FIG. 1.
Figure 4:
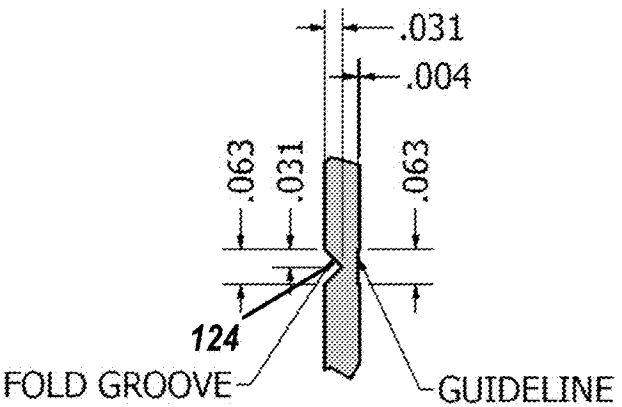
FIG. 4 shows detail A of FIG. 3 showing the fold groove.
Figure 5:
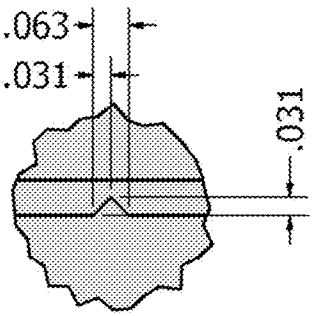
FIG. 5 shows detail B of FIG. 1 showing the undergroove profile.

The base 102 extends in a first plane. The first plane including the base 102 may be, for example, parallel to a wall surface. The backbone 104 is integrally formed with and extends out from the base 102 in a second plane. The second plane is perpendicular to the first plane having the base 102. The second plane including the backbone 104 may be, for example, parallel to a floor surface. An outward facing, or front, side 110 of the base and a downward facing, or bottom, side 114 of the backbone define a baseboard cavity 108, as shown in FIG. 3.

The mud flange 106 is integrally formed with and extends out from the backbone 104 in a third plane. The third plane is substantially perpendicular to the second plane having the backbone 104. The third plane is substantially parallel to and spaced apart from the first plane having the base 102. The third plane may be, for example, parallel to a wall surface and to the base 102. An upward facing, or top, side 112 of the backbone 104 and an inward facing, or back, side 116 of the mud flange 106 define a drywall cavity 118.

The base 102 of the straight baseboard reglet 100 extends in a range of 3 inches to 12 inches (e.g., 6.625 inches) from the bottom edge 120 to the backbone 104. The base 102 defines nail slots 122 extending through the base 102. Centers of the nail slots 122 are spaced roughly halfway between the bottom edge 120 of the base 102 and the backbone 104. The nail slots 122 are spaced apart from each other along a longitudinal axis 101 of the straight baseboard reglet 100 by 1 inch to 6 inches (e.g., 2.25 inches) as measured from the end of one slot to the end of the next adjacent slot. The nail slots 122 are provided, in part, to expose a view of framing studs in a wall. The nail slots 122 allow an installer to select studs to which the straight baseboard reglet 100 may be coupled.

The base further includes a plurality of fold grooves 124 on the rearward facing, or back, side 111 of the base 102, which is opposite of the frontward facing, or front, side 110 of the base 102. Each fold groove 124 comprises opposing angled, or transversely oriented, surfaces defining a fold channel or cutout in the base. Each fold groove 124 is spaced apart from the bottom edge 120 of the base by a predefined distance corresponding to a desired baseboard height and/or floor thickness. Each fold groove 124 is marked (e.g., color coded) to correspond to different installation situations. For example, when a 3½ inch baseboard is installed on top of a ¾ inch thick hardwood flooring, a user utilizes a fold groove marked for this combination. Upon folding the base 102 along the fold groove 124, a foot 126 is formed, extending out from the fold groove 124 at a right angle to the base 102.

Figure 6:
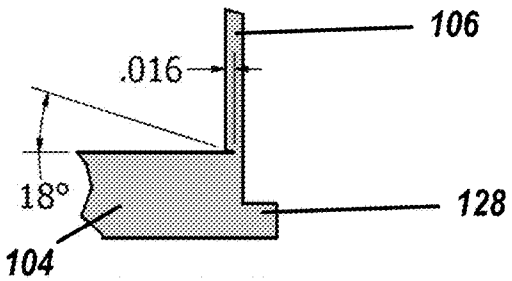
FIG. 6 shows detail C of FIG. 3 showing the breakaway mud flange groove.

The back side of the backbone 104 is flat and flush with the back side 111 of the base 102 (except for the area comprising the breakaway tab, which is described further below). However, the front side of the backbone 104 adjacent to the mud flange 106 includes a screed lip 128 protruding out from the plane of the mud flange 106, as shown in the detail of FIG. 6. The screed lip 128 effectively separates the straight baseboard reglet 100 into (i) a drywall portion at and above the screed lip 128 and (ii) a baseboard portion below the screed lip 128.

The mud flange 106 defines a pattern of perforations 132. The drywall cavity 118 receives the sheet of drywall, and the perforations 132 provide points of adherence for mud/drywall/joint compound when spread over the front side of the mud flange 106 (e.g., spread to the screed lip).

In practice, a user decides on (i) the thickness of flooring to be installed, and (ii) the finished height of the baseboard trim. Using those two parameters, a desired height is determined for both drywall installation and baseboard reglet installation. Then, one or more drywall panels are installed on a wall (e.g., by nails extending through the drywall panel and into the studs). The drywall is installed to match the desired height (e.g., a lower edge of the drywall panels may be 4 inches above a ground/floor/sub-floor or other flat flooring surface). The lower edge of the drywall panels can vary between ¼ inch to ½ inch from the desired height because the mud flange 106 of the straight baseboard reglet 100 can accommodate and overlap some variance in the drywall height.

Figure 12:
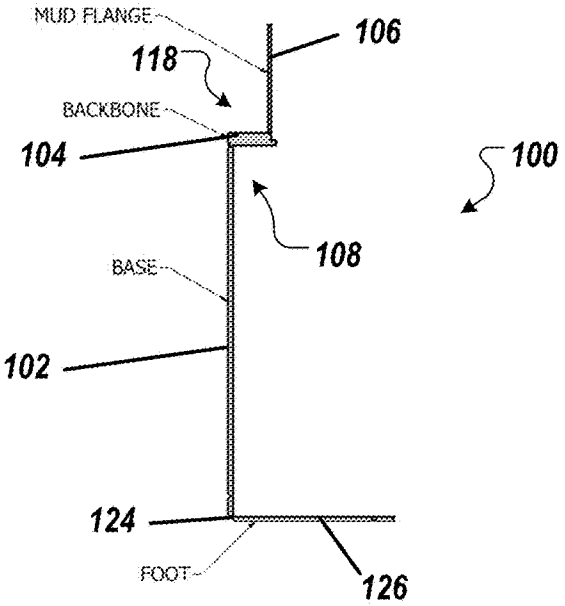
FIG. 12 shows a side view of FIG. 11.
Figure 13:
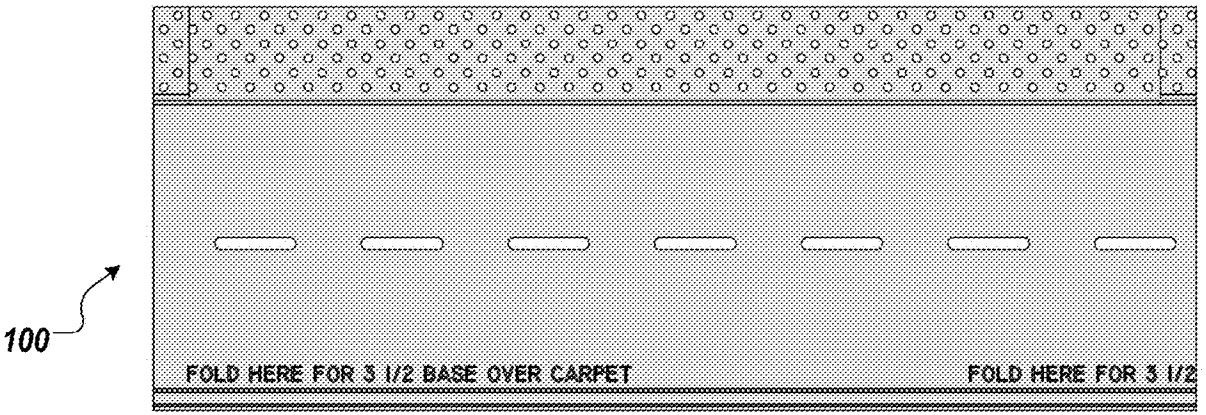
FIG. 13 shows a front view of FIG. 11.
Figure 11:
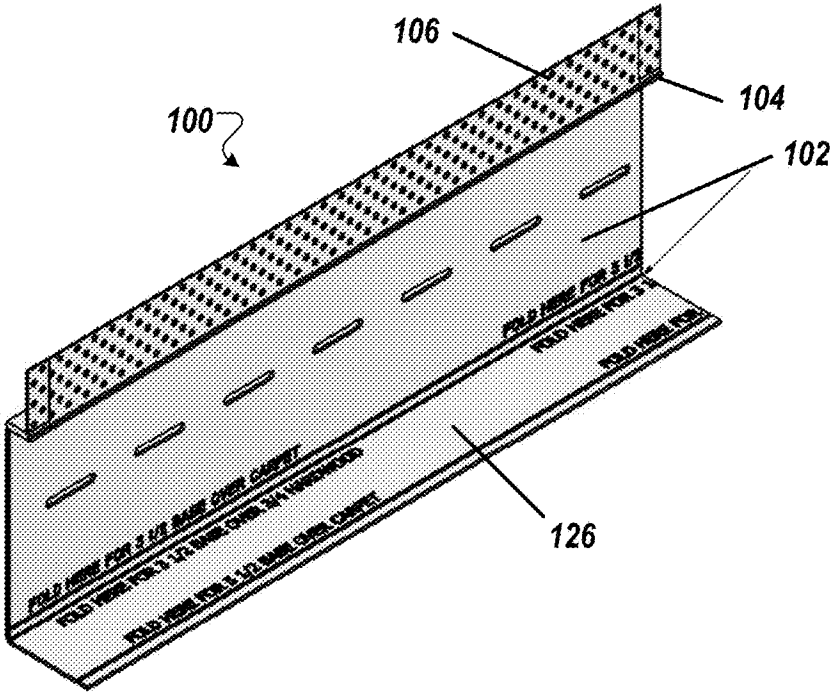
FIG. 11 shows an isometric view of the straight baseboard reglet of FIG. 1 with a fold groove folded to create a foot.

Once the drywall panels are installed, the straight baseboard reglet 100 is installed by folding one of the desired fold grooves 124 to form the foot 126 (as shown in FIGS. 11-13). The foot 126 is placed on the ground/floor/sub-floor or other flat flooring surface. The base 102 is pushed up against an unfinished wall (e.g., a plurality of studs or 2×4 boards vertically installed) such that the lower edge of the drywall is disposed in the drywall cavity 118 formed between the back side 116 of the mud flange 106 and the top side 112 of the backbone 104. Once in a desired location, the straight baseboard reglet 100 is nailed to the plurality of studs through the nail slots 122 to hold the straight baseboard reglet 100 firmly in place. The interface between the drywall panel and the mud flange 106 is then covered in mud or joint compound.

A baseboard trim piece is then installed in the baseboard cavity 108 formed by the bottom side 114 of the backbone 104 and the front side 110 of the base 102. The front surface of the baseboard trim may be co-planar with the front side of the mud flange 106. Such an arrangement forms an inset baseboard system. Furthermore, the baseboard trim may extend only a portion of the distance between the foot 126 adjacent to the floor surface and the bottom side 114 of the backbone 104, defining a gap between the baseboard and the backbone 104. For example, a gap of ¼ inch to 1 inch may remain between a top surface of the baseboard and the bottom side 114 of the backbone 104. This arrangement forms a gap reveal baseboard system.

Breakaway Tabs

Figure 7:
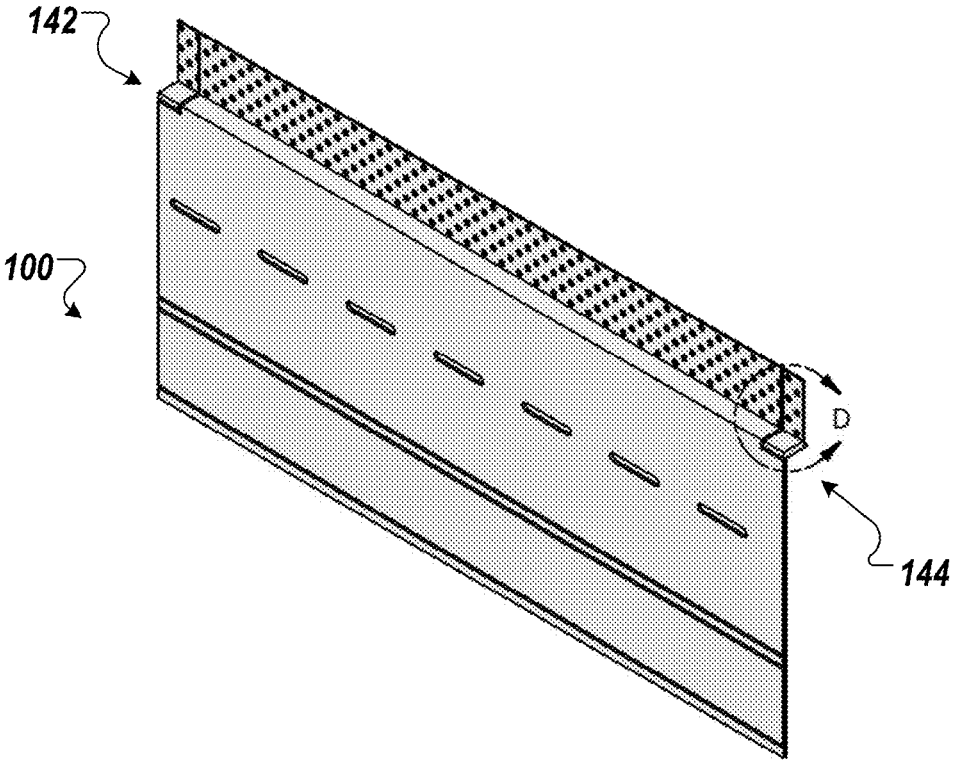
FIG. 7 shows a back isometric view of the straight baseboard reglet of FIG. 1.
Figure 8:
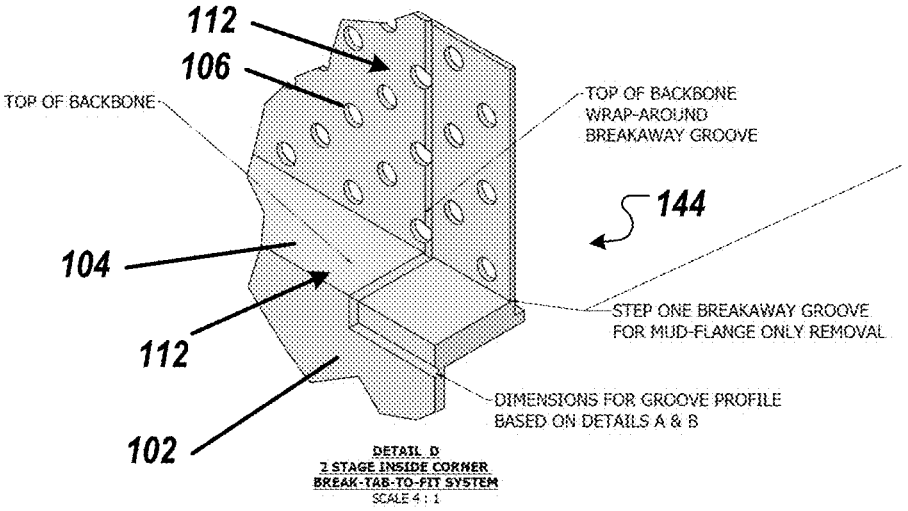
FIG. 8 shows detail D of FIG. 7 showing the breakaway tab.
Figure 9:
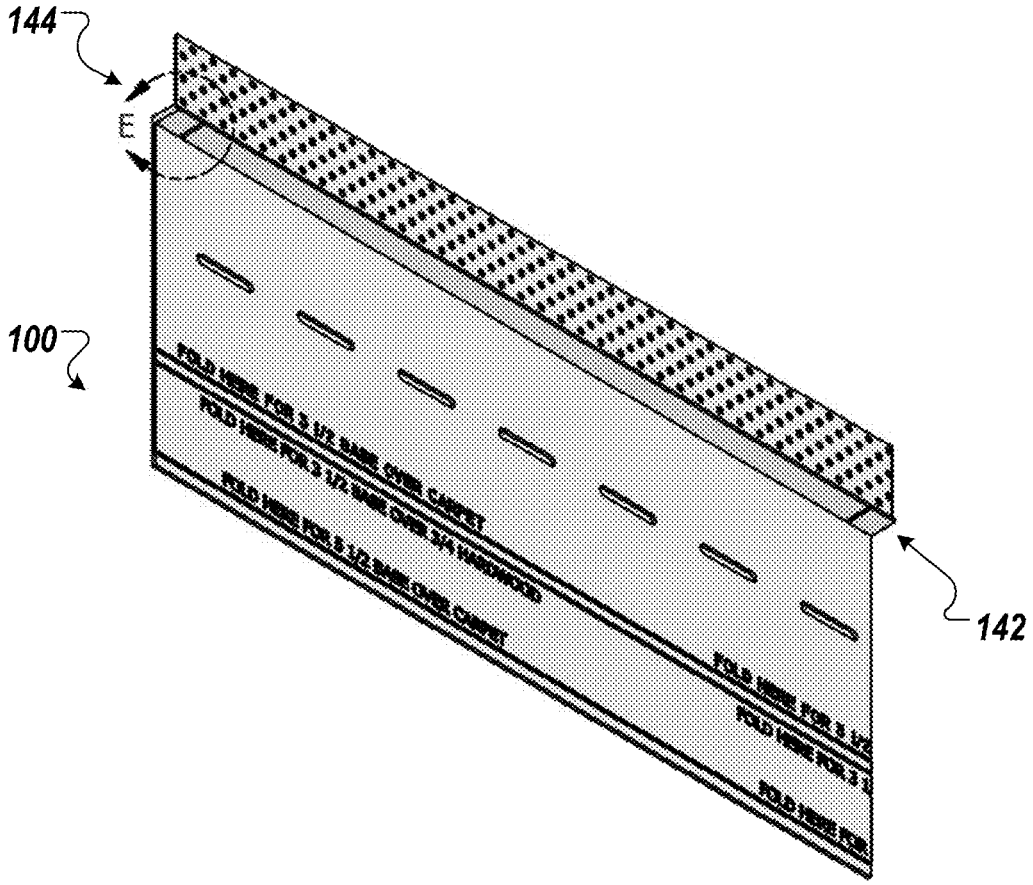
FIG. 9 shows another front isometric view of the straight baseboard reglet of FIG. 1.
Figure 10:
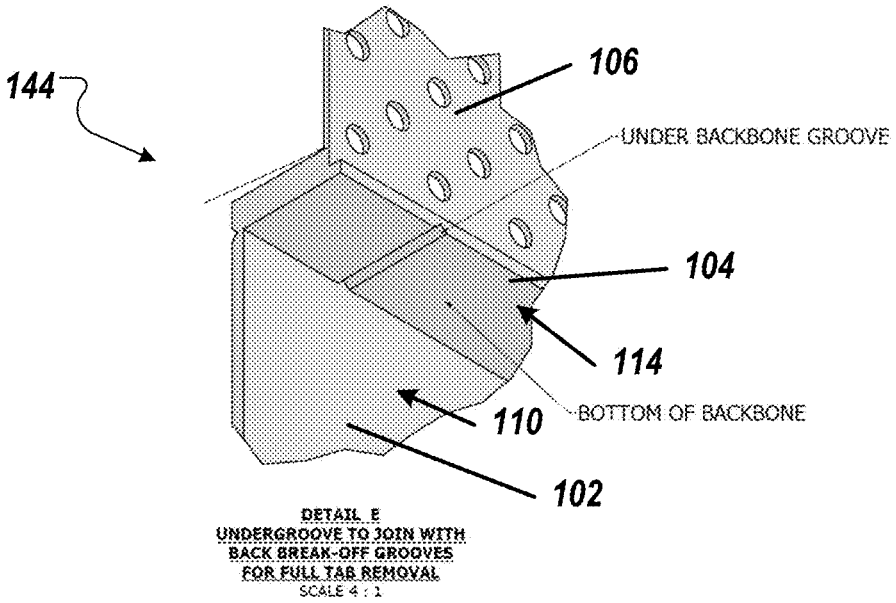
FIG. 10 shows detail E from FIG. 9 showing the undergroove that joins the breakaway tab of FIG. 8.

In some implementations, the straight baseboard reglet 100 includes breakaway tabs on opposing ends of the straight baseboard reglet 100. The breakaway tabs are used for creating a two-stage notching system to allow a flush or seamless junction between two baseboard reglets meeting at a corner (e.g., an inside corner). Such breakaway tabs may be seen in detail in FIGS. 7-10. For example, FIG. 7 shows a back top isometric view, and the corresponding detail in FIG. 8 shows the breakaway tab from the "drywall cavity" side. Furthermore, FIG. 9 shows a front isometric view from the bottom looking up, and the corresponding detail in FIG. 10 shows the breakaway tab from a "baseboard cavity" side. The breakaway tabs are attached to the straight baseboard reglet 100 via perforations, allowing for removal without a tool.

On a first end of the straight baseboard reglet 100, a first breakaway tab 142 comprises a perforation along a portion of the mud flange 106 such that the backbone 104 is left intact and exposed upon removal of the first breakaway tab 142. On a second end of the reglet, the second breakaway tab 144 comprises a perforation along a portion of the mud flange 106 and the backbone 104 such that only the base 102 is left intact and exposed upon removal of the second breakaway tab 144. In other words, the first breakaway tab 142 on the first end of the straight baseboard reglet 100 removes the mud flange portion, while the second breakaway tab 144 on the second end of the straight baseboard reglet 100 removes the mud flange and the backbone portions.

Figure 15:
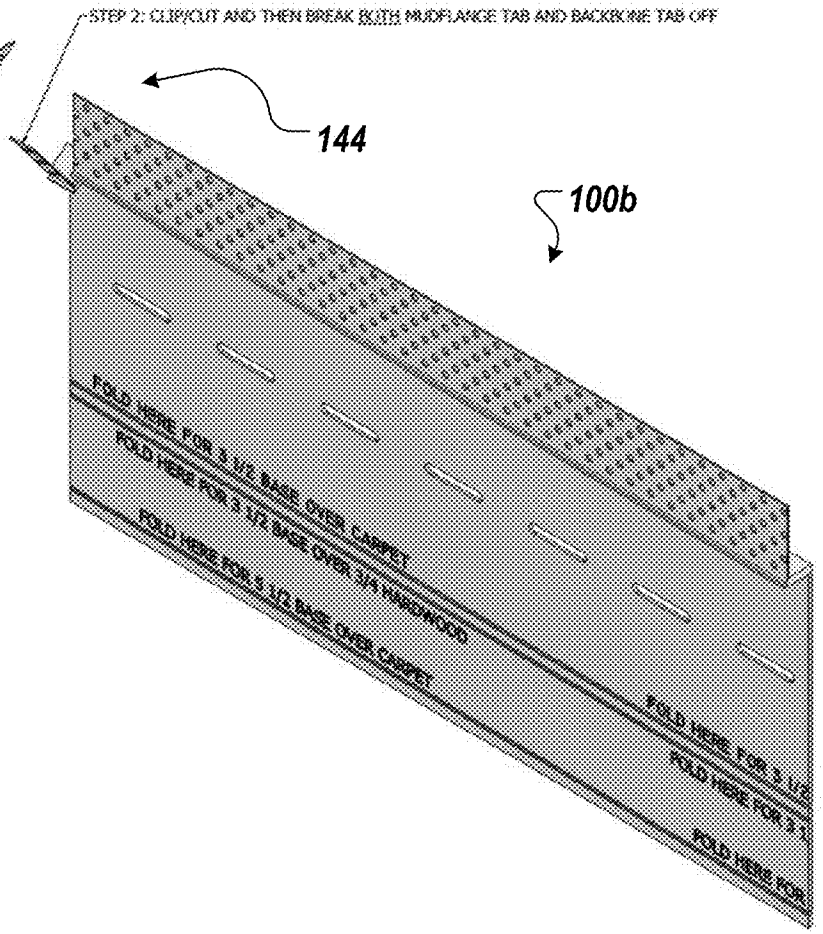
Figure 14:
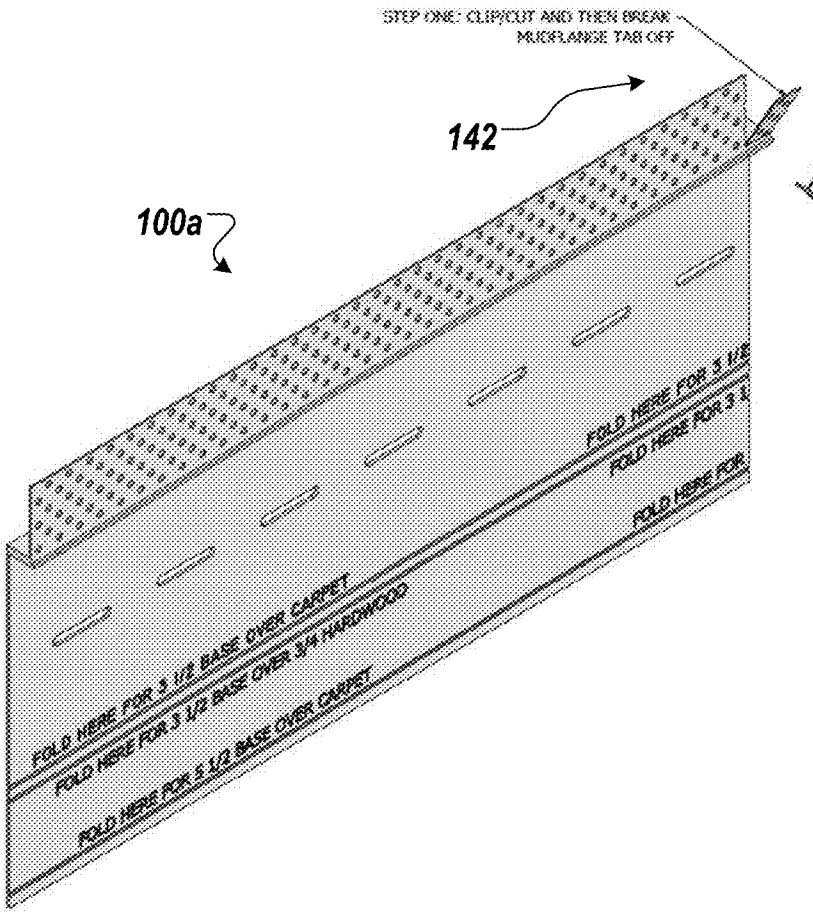
Figure 17:
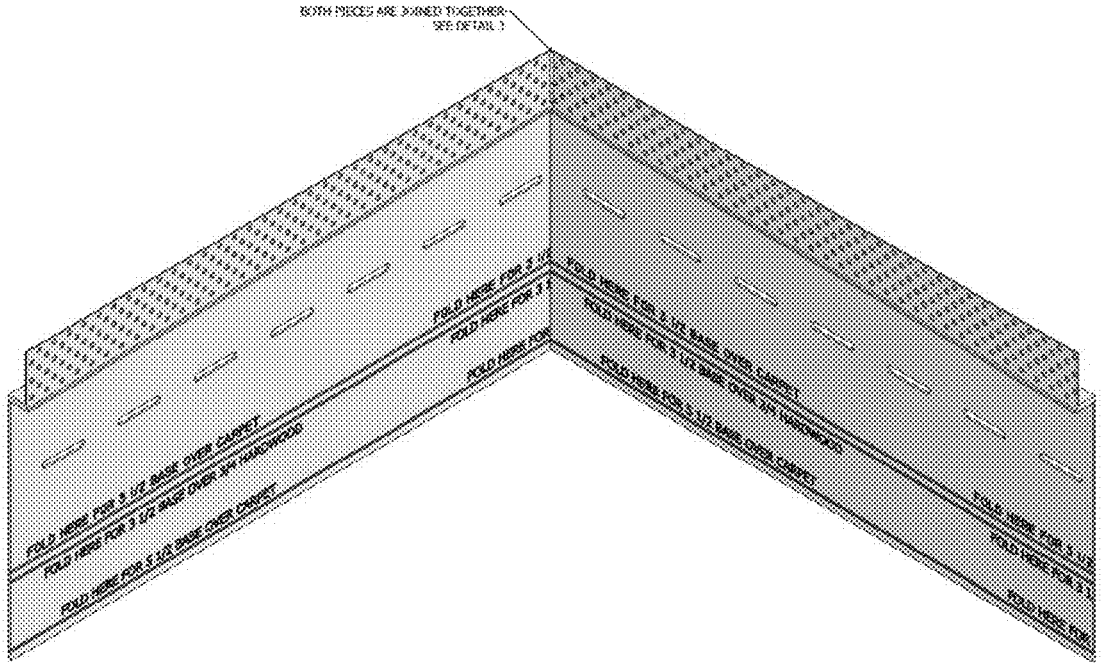
Figure 18:
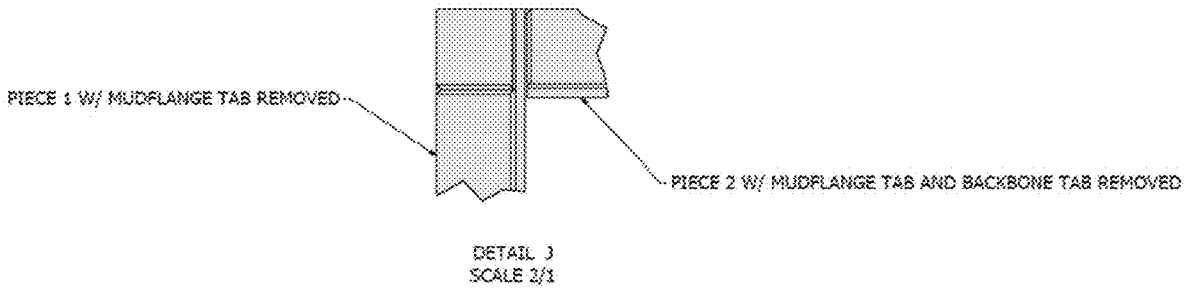
FIG. 18 shows a detailed view of the mudflange of the joined reglets of FIG. 17.

In installation, a first baseboard reglet 100*a*, shown in FIG. 14, is installed with the first end adjacent to an inside corner of a wall frame. The exposed backbone 104 and the base 102 pass beneath an installed drywall panel to contact the framing. A second baseboard reglet 100*b*, shown in FIG. 15, is installed with the second end adjacent to the inside corner of the wall frame. The exposed backbone 104 of the first baseboard reglet 100*a* engages the space from the removed backbone of the second baseboard reglet 100*b*. Thus, a smooth and continuous transition is formed between the base 102 and the mud flange 106 of each baseboard reglet.

Corner Baseboard Reglets

Figure 19:
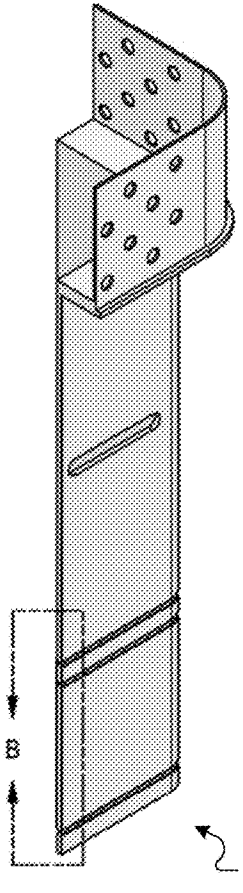
FIG. 19 shows a side isometric view of a corner baseboard reglet, according to one implementation.
Figure 25:
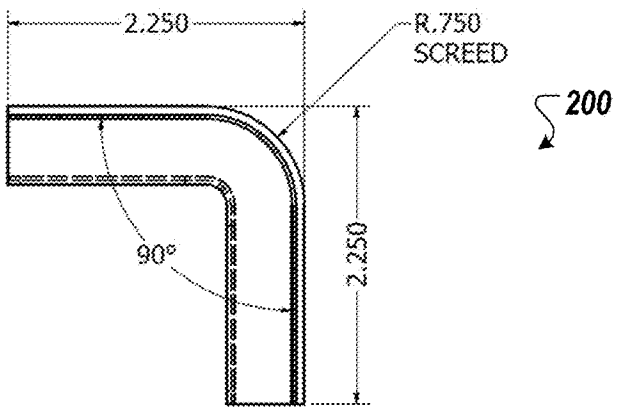
FIG. 25 shows a top view of the corner baseboard reglet of FIG. 19.
Figure 26:
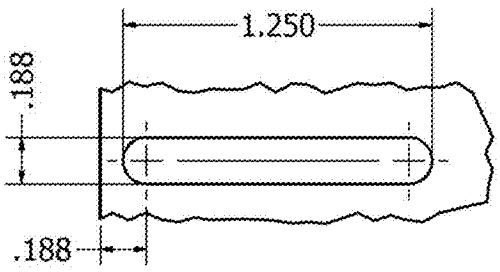
FIG. 26 shows a detail of the nail slot in FIG. 23.
Figure 24:
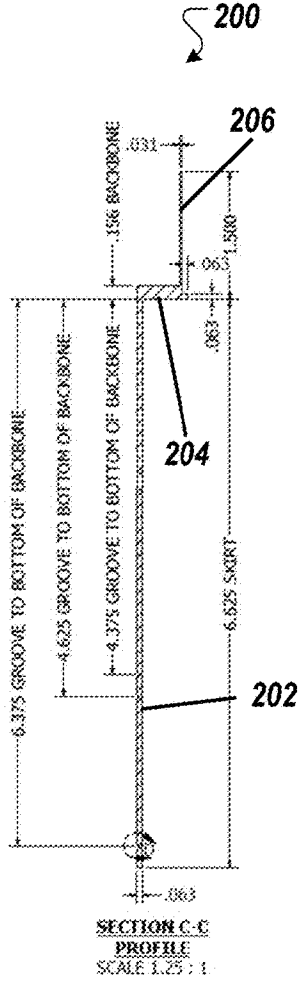
FIG. 24 shows a cross section of the corner baseboard reglet along line CC in FIG. 23.
Figure 23:
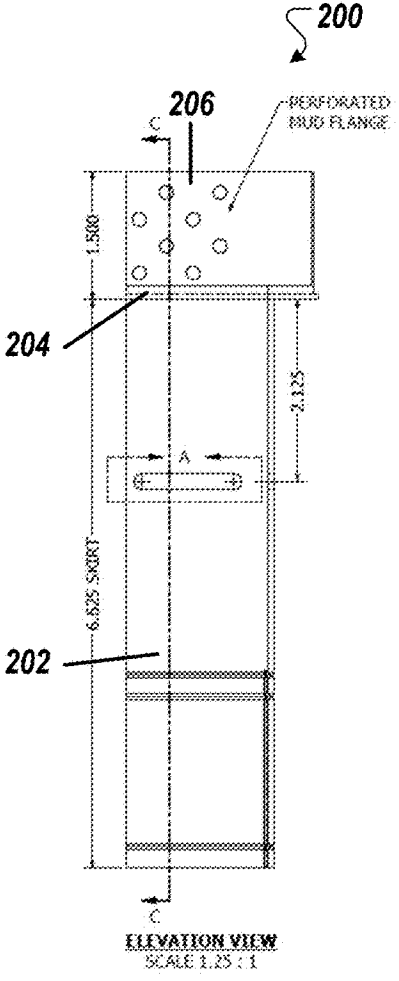
FIG. 23 shows a side view of the corner baseboard reglet of FIG. 19 with associated dimensions in inches.

FIGS. 19-26 shows a corner baseboard reglet 200 that is similar in shape and function to the straight baseboard reglet 100 shown in FIG. 1 except as described below. The corner baseboard reglet 200 in FIG. 19 is a curved or bullnose-shaped reglet for an outside corner of a wall. Each of the base 202, the backbone 204, and the mud flange 206 of the corner baseboard reglet 200 includes two opposing sides 201, 203 arranged at a right angle relative to each other and meeting at a rounded corner. For example, the second side 203 may be disposed at an angle between 0 and 180 degrees with respect to the first side 201 of the corner baseboard reglet 200.

For example, a first side may include a first base, a first backbone, and a first mud flange, while the second side may include a second base, a second backbone, and a second mud flange. Similar to the straight baseboard reglet 100, the first base of the first side of the curved baseboard reglet extends in a first plane. The first backbone is integrally formed with and extends from the first base in a second plane that is substantially perpendicular to the first plane. The first mud flange is integrally formed with and extends from the first backbone in a third plane that is substantially perpendicular to the second plane. The third plane is substantially parallel to and spaced apart from the first plane having the first base. Similarly, the second side of the corner baseboard reglet may have a second base, second backbone, and second mud flange. The second base extends in a fourth plane which may be parallel to a wall surface. The second backbone is integrally formed with and extends from the second base in the second plane aligned with the first backbone to form a continuous corner backbone. The second plane is perpendicular to the fourth plane. The second mud flange is integrally formed with and extends from the second backbone in a fifth plane that is substantially perpendicular to the second plane. The fifth plane is substantially parallel to and spaced apart from the fourth plane.

The mud flange 206 of the corner baseboard reglet 200 includes two opposing sides continuously formed to meet at a curved portion 208 having a radius of curvature in a range of ¼ inch to 2 inches (e.g., 0.75 inches as shown in FIG. 19). However, the perforations of the mud flange may or may not continue along the curved portion of the mud flange. In the implementation shown in FIG. 19, no perforations are defined along the curved portion 208 of the mud flange 206. Similarly, the backbone 204 is also continuously formed with a radius of curvature in a range of ¼ inch to 2 inches (e.g., 0.75 inches as shown in FIG. 19).

Figure 21:
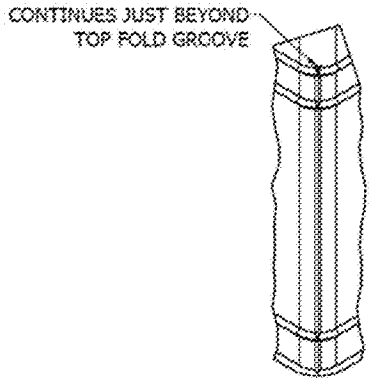
FIG. 21 shows a detail view of the corner of FIG. 20.
Figure 22:
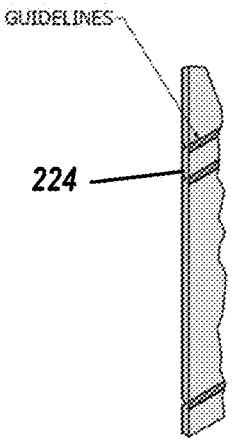
FIG. 22 shows a detail view of the edge of FIG. 19.
Figure 20:
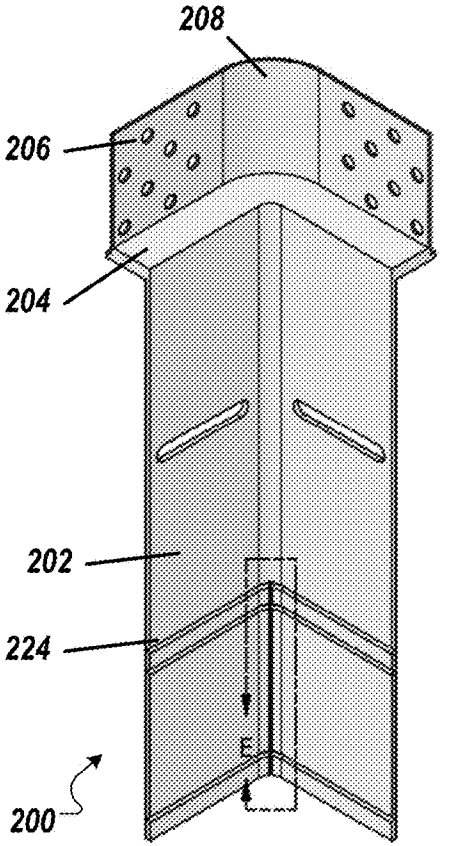
FIG. 20 shows a back isometric view of the corner baseboard reglet of FIG. 19.
Figure 28:
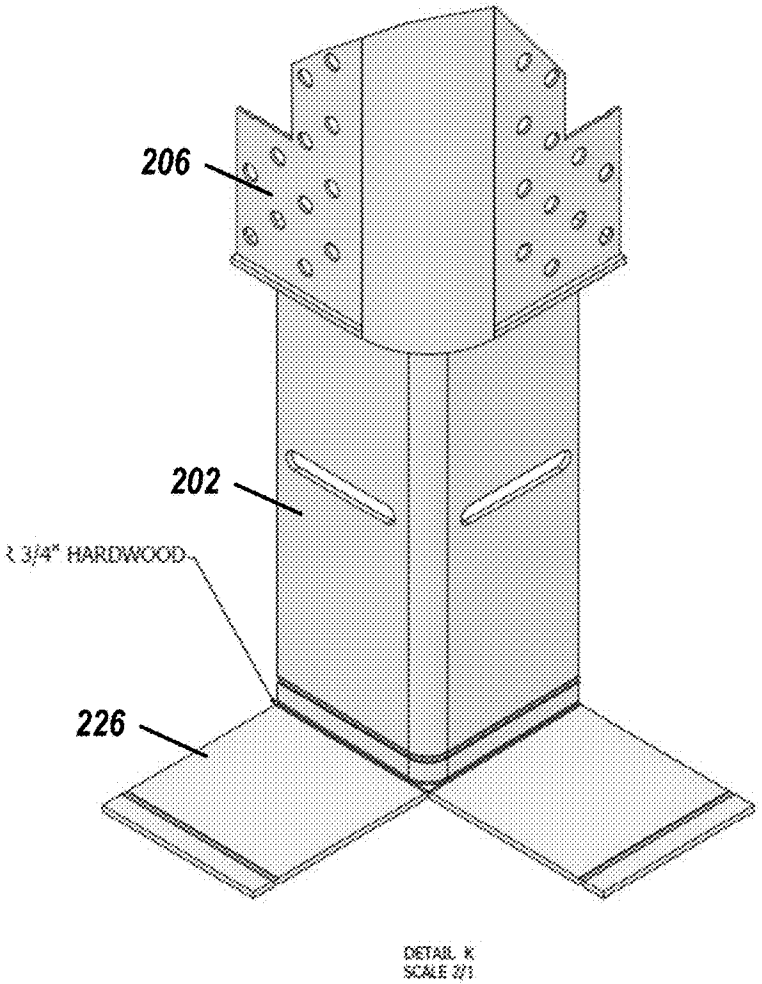
FIG. 28 shows a detail view of the corner baseboard reglet of FIG. 27.
Figure 27:
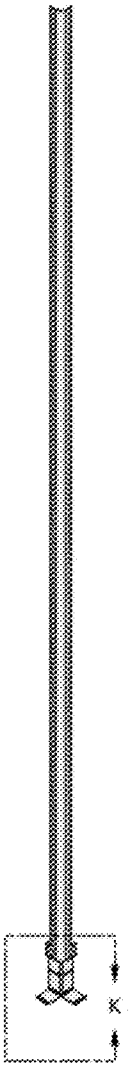
FIG. 27 shows an isometric view of a corner baseboard reglet with an extended mud flange corner piece, according to another implementation.

The base 202 of the corner baseboard reglet 200 includes two opposing sides 201, 203 coupled via a rounded corner. For example, each of the two opposing sides of the base meet at a radius of curvature (e.g., less than 0.1 inches) where each fold groove 224 extends around the radius of curvature to maintain a continuous fold groove around the corner (as shown in FIG. 21). In some implementations, a slit is cut (e.g., on-site or pre-cut) along the rounded corner of the base from the first edge to the selected fold groove to allow the foot to be formed around the corner. For example, FIG. 27-28 show an implementation of a corner baseboard reglet 200 with folded fold grooves 224 forming a foot 226 on each opposing side 201, 203 of the base of the corner baseboard reglet 200. In other implementations, the two opposing sides of the base of the corner baseboard reglet meet at a right angle, which is covered by a baseboard trim piece when installed.

The corner baseboard reglet (or "bullnose reglet") of FIG. 19 is configured to accept two opposing drywall panels in each of the drywall cavities at a right angle with respect to each other. In some implementations, a separate bullnose corner joining flange may be installed above the reglet to form a bullnose corner. The separate bullnose joining flange may extend from the mud flange to the ceiling. In other implementations, the mud flange extends upwards (e.g., up to the ceiling) as shown in FIG. 27. Thus, the corner baseboard reglet allows for the installation of bullnose trim and drywall with a bullnose corner joining flange. For example, the corner baseboard reglet allows for an arrangement including recessed baseboard trim having a bullnose corner installed flush with drywall having a bullnose corner.

Manufacturing Processes

The manufacturing process for the various reglets and other components described herein may be accomplished by an injection molding process. For example, the various reglets shown in FIGS. 1-28, 38-44, and 49-101 (including the corner baseboard reglets, the doorjamb reglets, and the clip-on baseboard system) may comprise Polyvinyl Chloride (PVC) and may be formed by an injection molding manufacturing process. In some implementations, an extrusion process may be used to form the various reglets of this disclosure. PVC provides sufficient flexibility to tolerate the impacts of nailing and fastening on the thin mud flange while also maintaining rigidity in the thicker backbone and shaped corners.

The composition of the PVC used in the various implementations of this disclosure (e.g., injection molding or extrusion) may vary in consideration of a variety of factors. For example, the viscosity of the materials, when heated to their processing temperature or melting temperature, is one such consideration. In some implementations, PVC material used for extrusion may be formulated with a higher viscosity at the processing temperature to maintain the extruded profile without distortion. In some implementations, PVC material used for injection molding may be formulated with a lower viscosity at the processing temperature to completely fill the mold with the pressurized fluid (e.g., the melted or semi-fluid PVC material).

The composition of the PVC material may include an additive blend (e.g., plasticizers) to account for variables in the manufacturing equipment and production speeds. Added plasticizers may provide a lower viscosity PVC material having a higher fluidity (or flow rate) at the processing temperature. The exact formulation of the PVC material may be adjusted to balance pliability (e.g., resistance to impact fracture) with rigidity (e.g., holding the profile shape during installation).

The disclosed process of injection molding a PVC component includes creating at least two negative mold halves that reflect the finished design shape and dimensions. The negative mold halves are built to compensate for any of the anticipated possible shrinkage and/or distortion that may occur after the release and cooling of the part. Multiple pairs of the two-part molds may be joined as a group. The two-part mold is then injected under pressure with heated, liquefied PVC plastic through ports and pathways in the molds. Vacuum assistance may be incorporated through the exit ports to assure complete and thorough filling of the molds before the PVC begins to solidify. Once the plastic has solidified sufficiently, the mold halves are removed, and the part is released. The remnant plastic from the injection gates is trimmed flush to the edge of the part.

Following the injection molding process, a printing machine and/or process prints a color on the recessed print paths on the front side of the parts directly opposite the folding grooves on the back side of the parts. For example, the fold groove for a 3½" base may be colored orange. These colors match the color-coded lines and printed instructions that are on the front of the straight baseboard reglet. The finished part can then be attached to other components of the system, including the straight baseboard reglet, which may be an extruded PVC component.

In another manufacturing implementation of the corner baseboard reglet of this disclosure (e.g., the corner baseboard reglet 200), a series of steps is shown in FIGS. 29-33 may be performed to modify an aluminum straight baseboard reglet.

Figure 29:
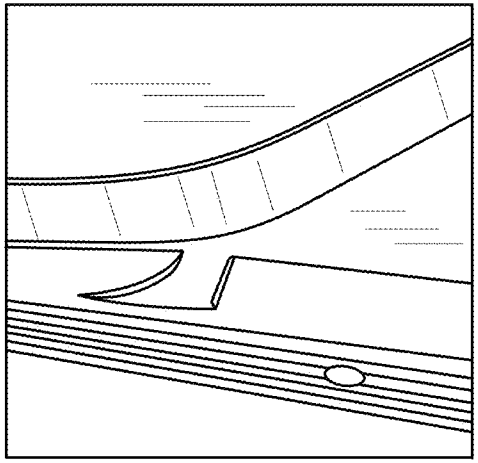
FIGS. 29-33 show images of a manual manufacturing process for a corner baseboard reglet, according to one implementation.
Figure 30:
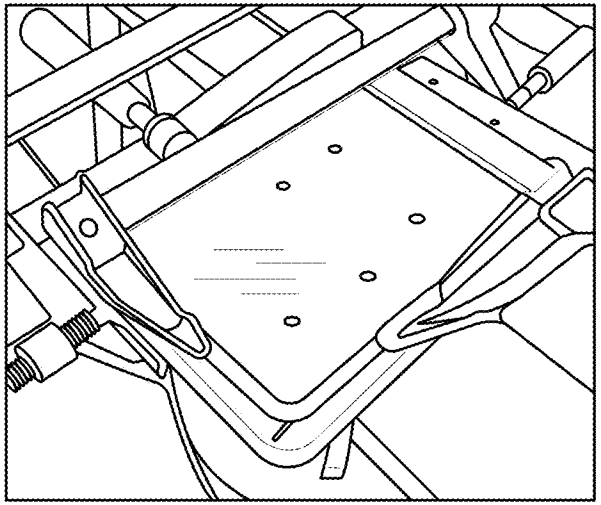
Figure 31:
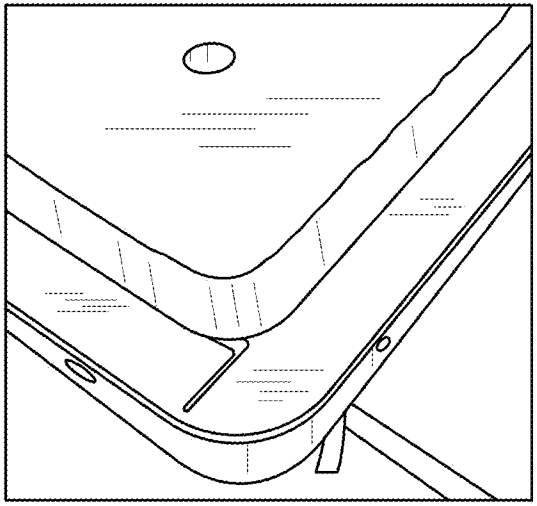
Figure 32:
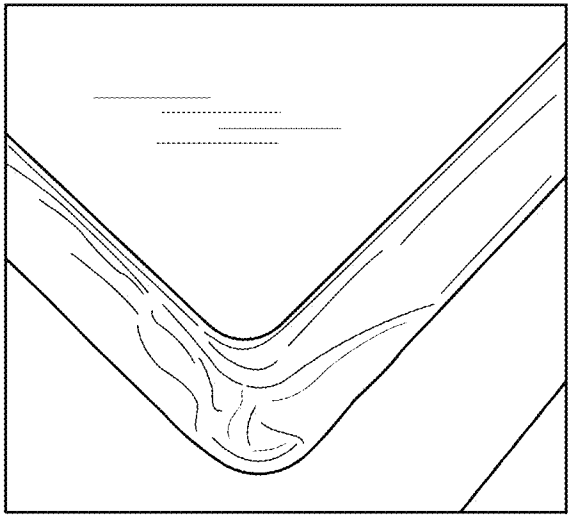
Figure 33:
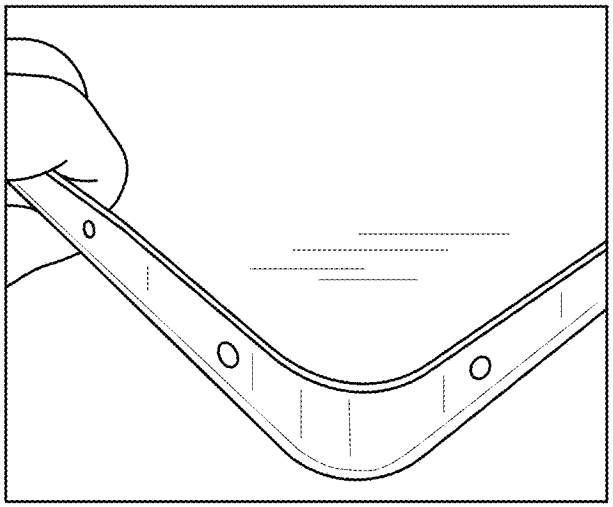
Figure 35:
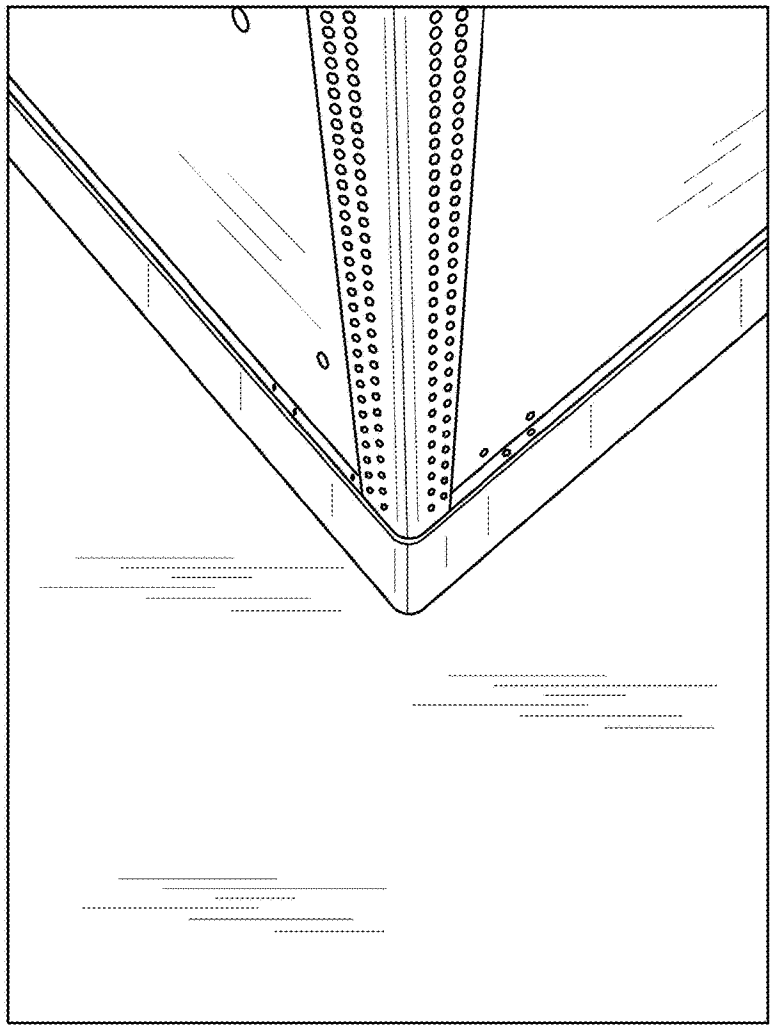
FIGS. 34-35 show images of an installed corner baseboard reglet, according to one implementation.
Figure 34:
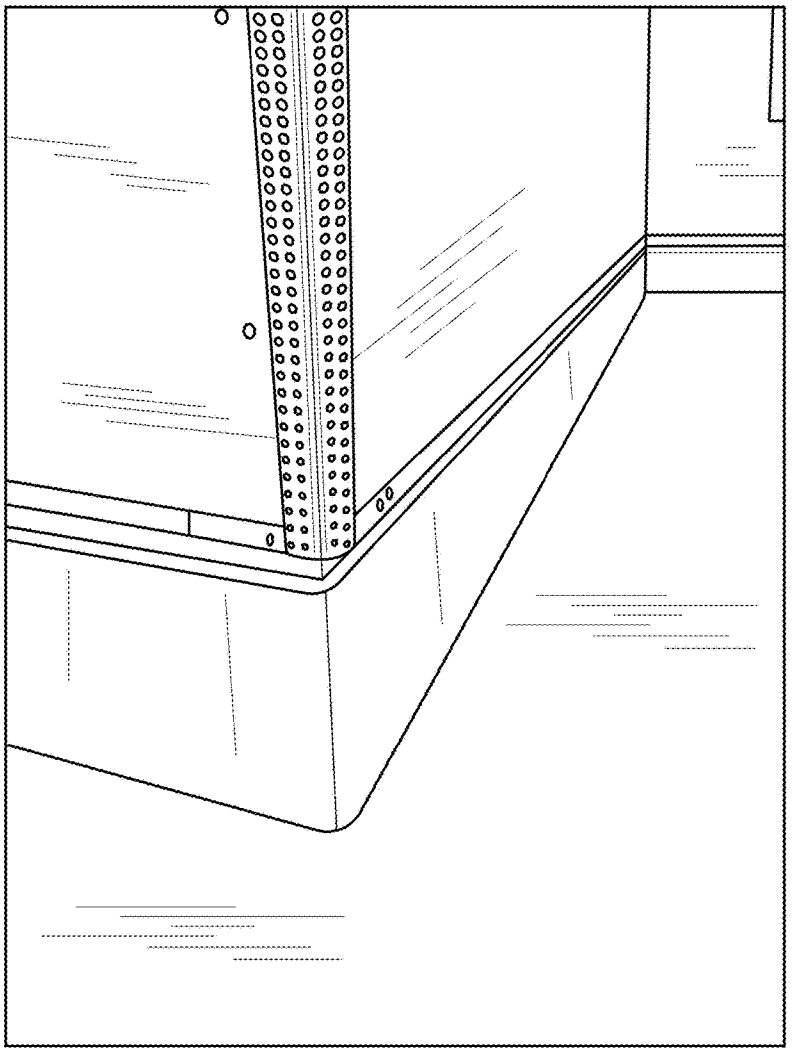
Figure 37:
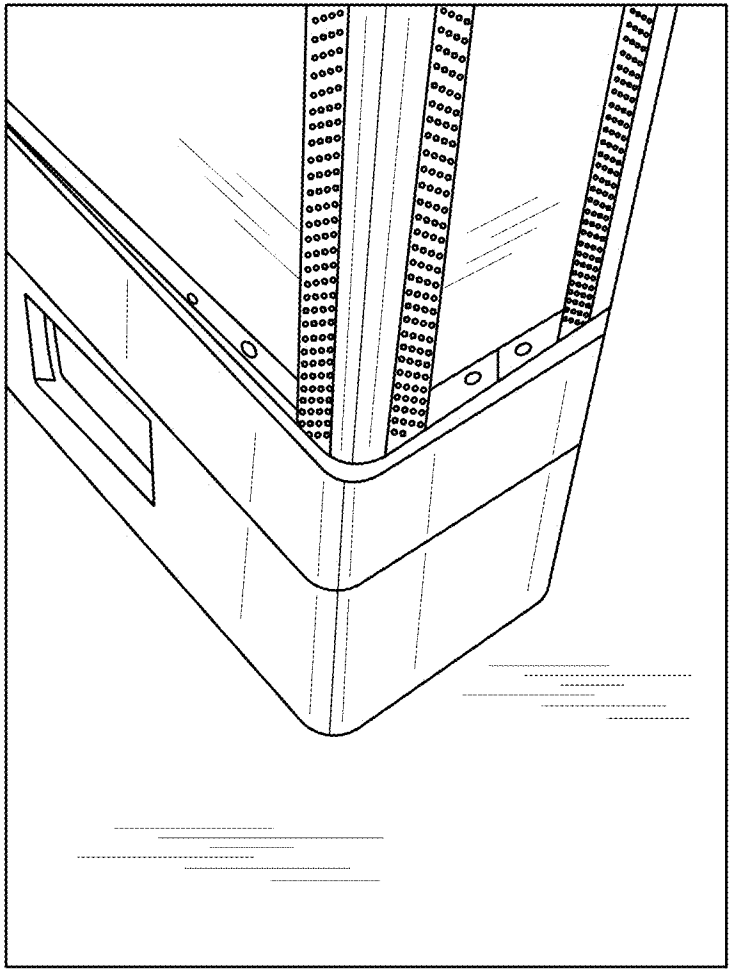
FIGS. 36-37 show images of an installed corner baseboard reglet, according to another implementation.
Figure 36:
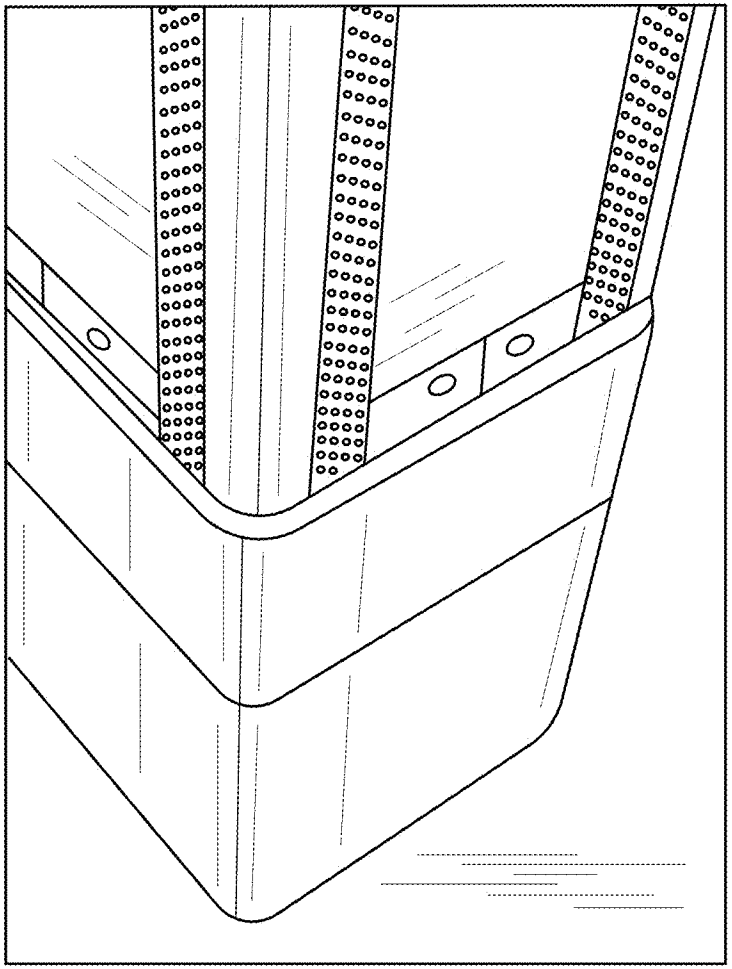
Figure 40:
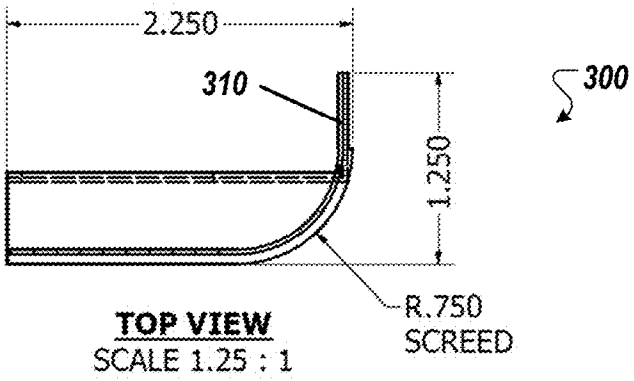
FIG. 40 shows a top view of the corner baseboard reglet of FIG. 38.
Figure 41:
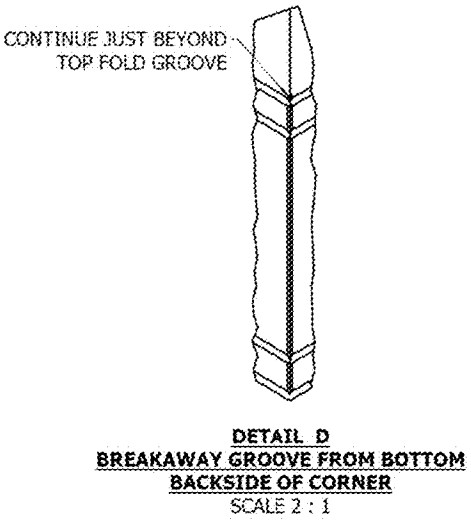
FIG. 41 shows a detail view of the corner and fold grooves of the corner baseboard reglet of FIG. 38.
Figure 39:
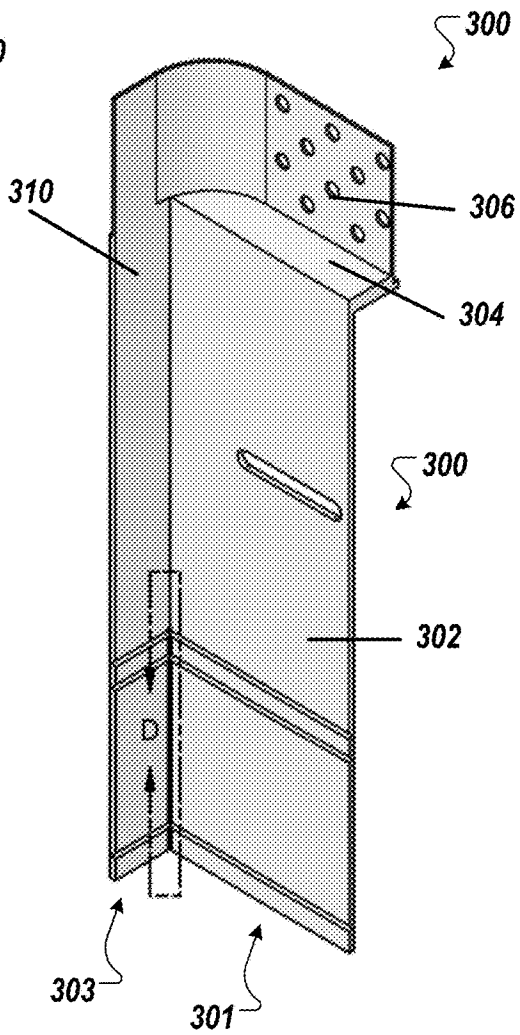
FIG. 39 shows a back isometric view of the doorjamb-adjacent corner baseboard reglet of FIG. 38.

First, a curved cut is made through the backbone, as shown in FIG. 29. The radius of the curved cut corresponds to a radius of curvature of the exterior surface of the mud flange of the fully fabricated corner baseboard reglet. A curved, cut portion of the backbone is removed to form a cavity. Then, the opposing sides of each of the base, the backbone, and the mud flange of the reglet are bent to shape (e.g., to the desired radius of curvature), which closes the cavity formed by the cut in the backbone, as shown in FIGS. 30 and 31. The portions of the backbone are then welded back together to form a continuous piece with the desired radius of curvature, as shown in FIG. 32.

An image of the resulting corner baseboard reglet with a baseboard and drywall panels installed relative to the reglet is shown in the set of images in FIGS. 34-35 and FIGS. 36-37. As shown, the installed baseboard trim includes a bullnose corner matching the radius of curvature of the mud flange of the corner baseboard reglet. The images shown include a gap between the drywall and the trim.

The corner baseboard reglet described herein may be modified for a variety of geometries, structures, sizes, and configurations to accommodate various construction situations. For example, FIGS. 38-44 show curved reglets for installation adjacent to a doorjamb (one for being installed to the left of the doorjamb and the other for being installed to the right of the doorjamb). The doorjamb-adjacent curved baseboard reglets 300 shown has two opposing sides 301, 303 that intersect at 90°. The doorjamb-adjacent baseboard reglet includes a base 302, a backbone 304, and a mud flange 306 on the first side 301. However, on the second side 303, a slotted doorjamb flange 310 extends from a top end to a bottom end of the reglet 300 in a fourth plane. The fourth plane is substantially perpendicular to each of the first plane (having the base 302) and the second plane (having the backbone 304) such that the base 302 and the slotted doorjamb flange 310 meet at a substantially right angle. The slotted doorjamb flange 310 is planar and, when installed, extends around the edge of the wall surface and is configured to be installed in a slot defined adjacent to the door frame to further align and secure the reglet 300 in place.

The doorjamb-adjacent corner baseboard reglet 300 shown in FIGS. 38-44 is configured to form a curved or bullnose interface between a wall section and a doorjamb. The recessed baseboard that is installed in the baseboard cavity of the reglet terminates in a curved portion at one end thereof that matches the radius of curvature of the curved portion of the mud flange. Images of the installed corner baseboard reglet with the doorjamb slot piece installed are shown in FIGS. 45-48.

FIGS. 49-54 show a sharp outside corner on a corner baseboard reglet, similar to the reglet of FIG. 19, except as described below. The base and the mud flange of the reglet each have two opposing sides that are arranged at right angles relative to each other as shown in the corner baseboard reglet of FIGS. 49 and 50. The backbone extends between the mud flange and the base. FIGS. 55-60 similarly show a sharp corner implementation of a doorjamb-adjacent corner baseboard reglet.

In other implementations, the corner baseboard reglets described herein may have a different radius of curvature. For example, a corner baseboard reglet (e.g., similar to the reglet of FIG. 19, or similar to a doorjamb adjacent reglet) may have a curved portion of the mud flange with a ½ inch radius of curvature.

Figure 38:
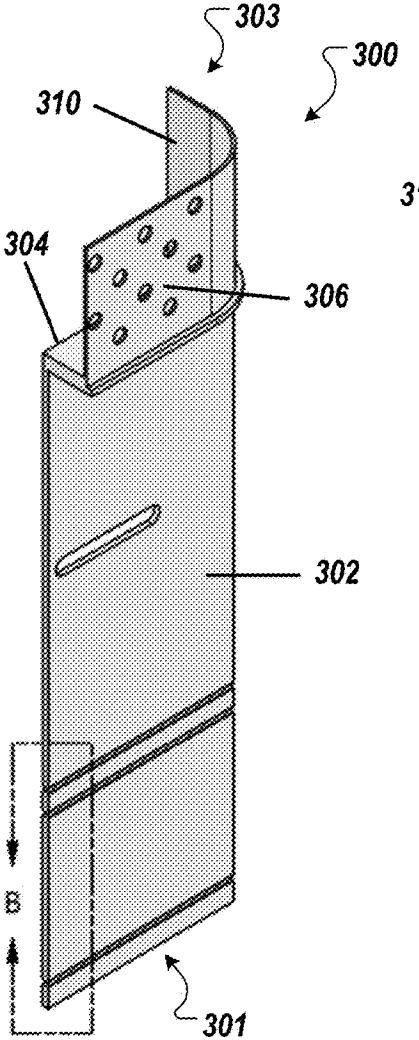
FIG. 38 shows a front isometric view of a corner baseboard reglet for installation adjacent to a doorjamb, according to one implementation.
Figure 44:
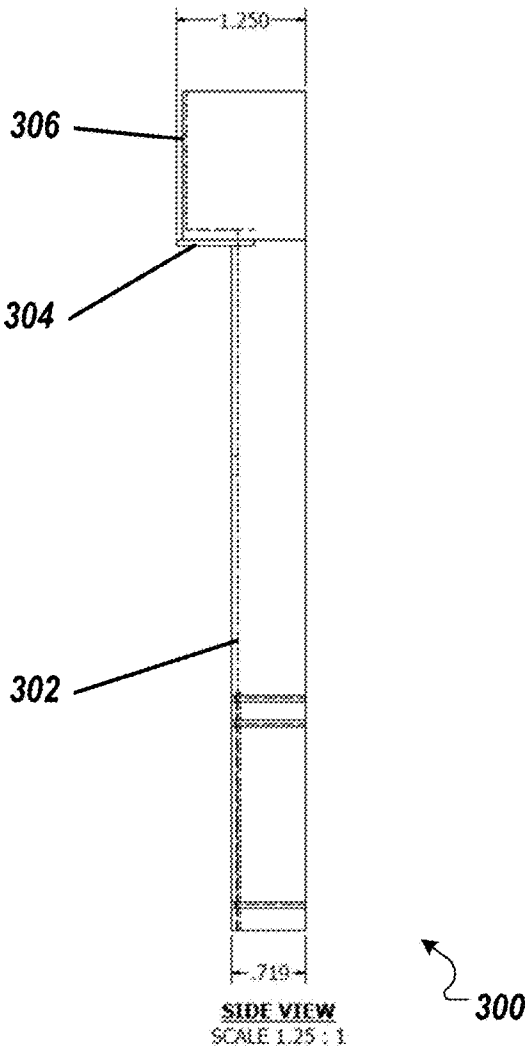
FIG. 44 shows another side view of the corner baseboard reglet of FIG. 38.
Figure 43:
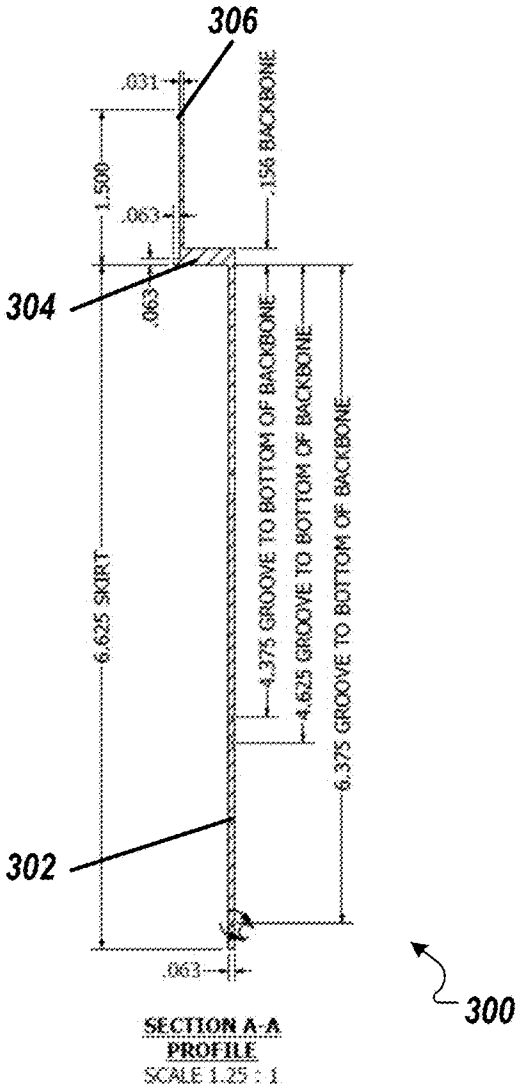
FIG. 43 shows a cross section along line AA in FIG. 42.
Figure 42:
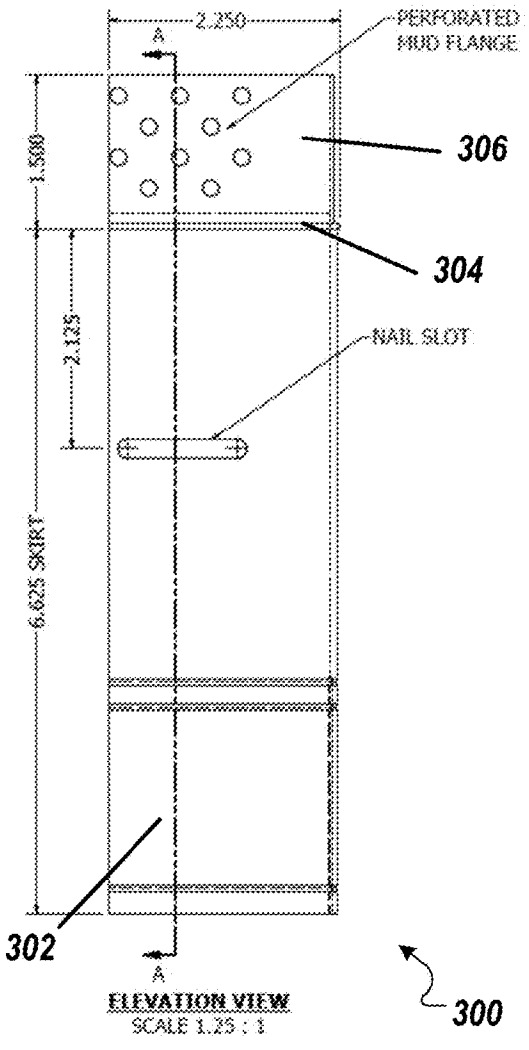
FIG. 42 shows a side view of the corner baseboard reglet of FIG. 38.
Figure 45:
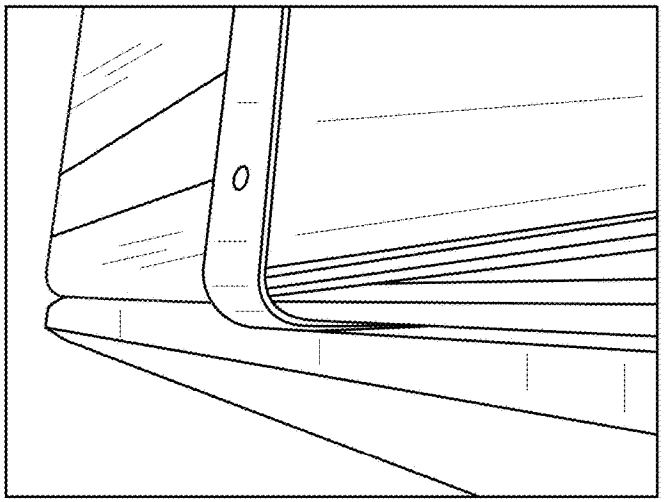
FIGS. 45-48 show images of corner baseboard reglet installed adjacent to a doorjamb, according to one implementation.
Figure 46:
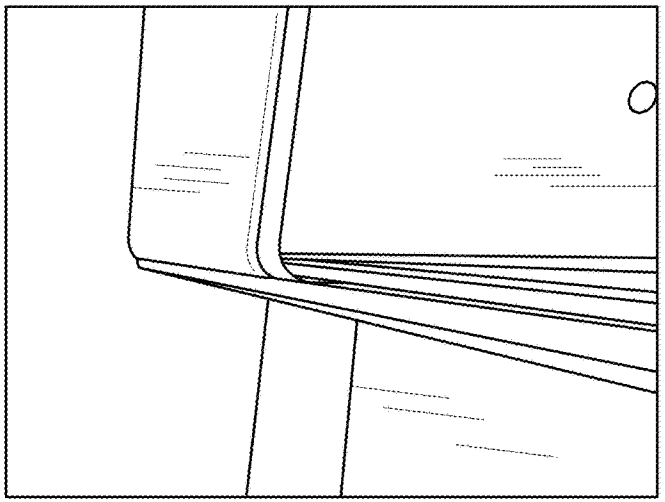
Figure 47:
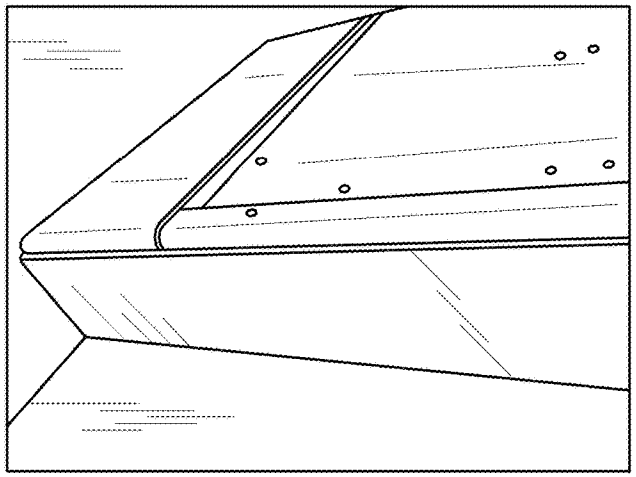
Figure 48:
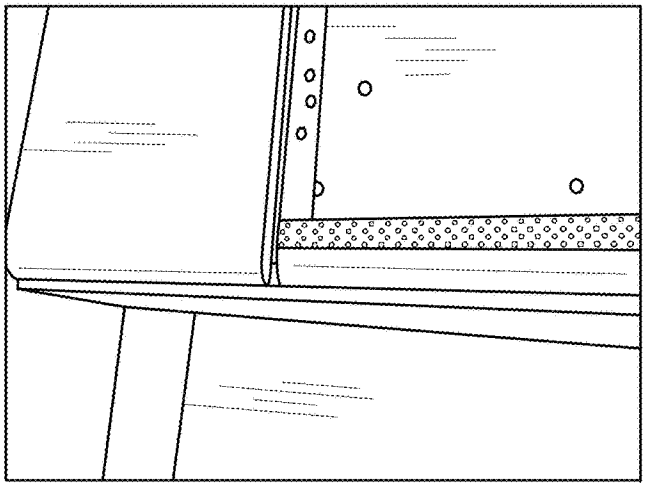
Figure 50:
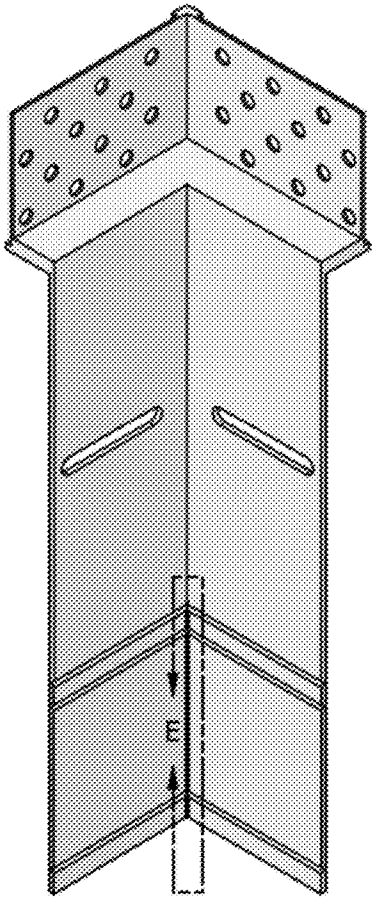
FIG. 50 shows a back isometric view of the corner baseboard reglet of FIG. 49.
Figure 49:
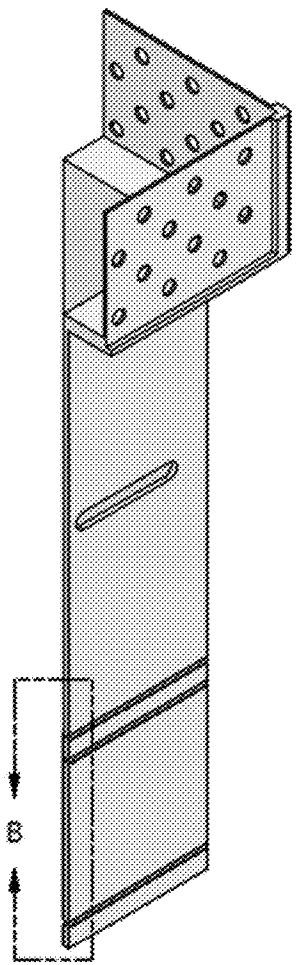
FIG. 49 shows a side isometric view of a corner baseboard reglet having a sharp corner, according to one implementation.
Figure 51:
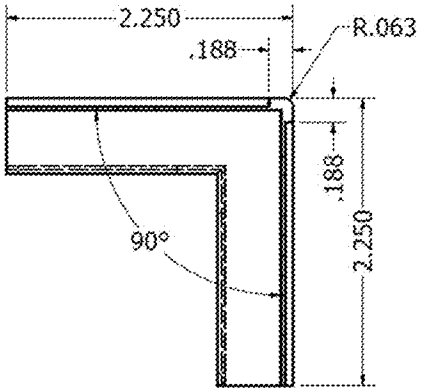
FIG. 51 shows a top view of the corner baseboard reglet of FIG. 49.
Figure 52:
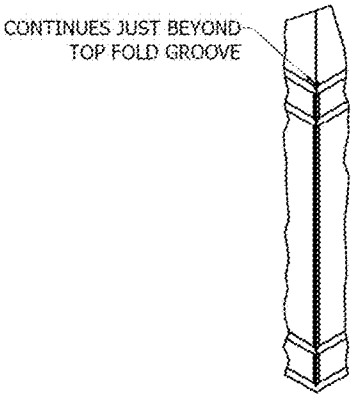
FIG. 52 shows a detail view of the corner and fold grooves of the corner baseboard reglet of FIG. 49.
Figure 54:
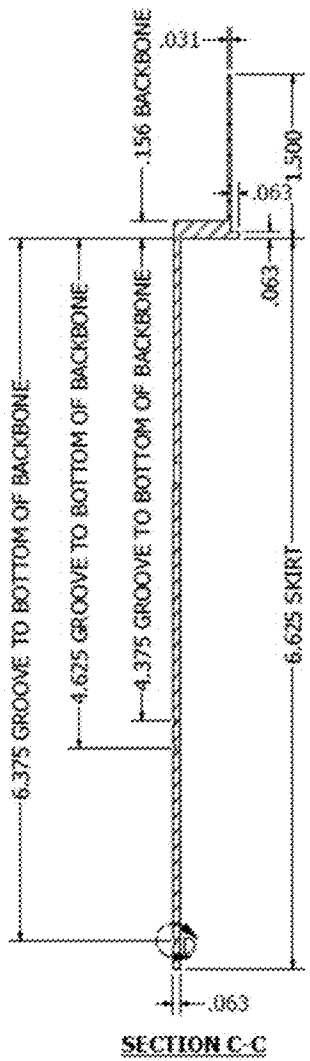
FIG. 54 shows a cross section along line CC in FIG. 53.
Figure 53:
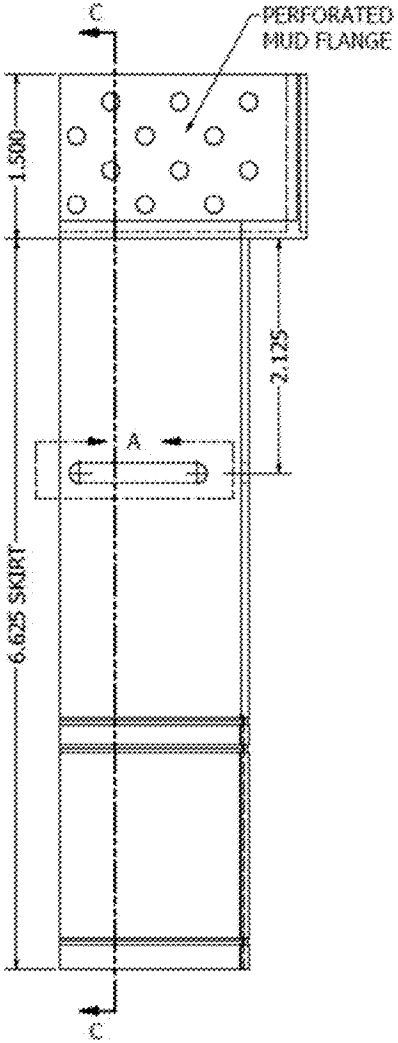
FIG. 53 shows a side view of the corner baseboard reglet of FIG. 49.
Figure 57:
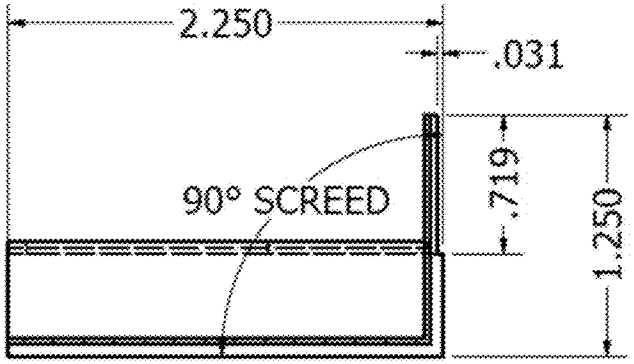
FIG. 57 shows a top view of the corner baseboard reglet of FIG. 55.
Figure 56:
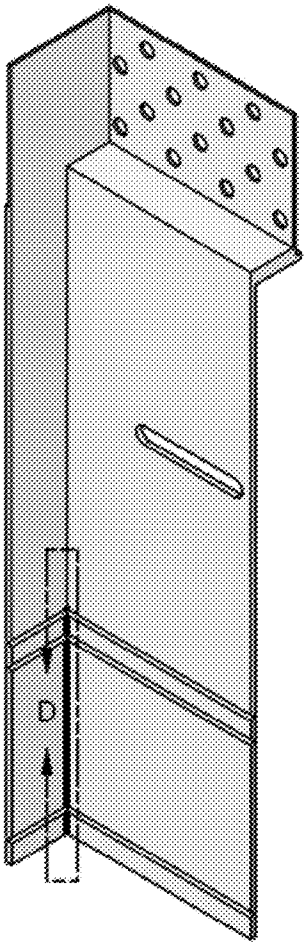
FIG. 56 shows a back isometric view of the doorjamb-adjacent corner baseboard reglet of FIG. 55.
Figure 55:
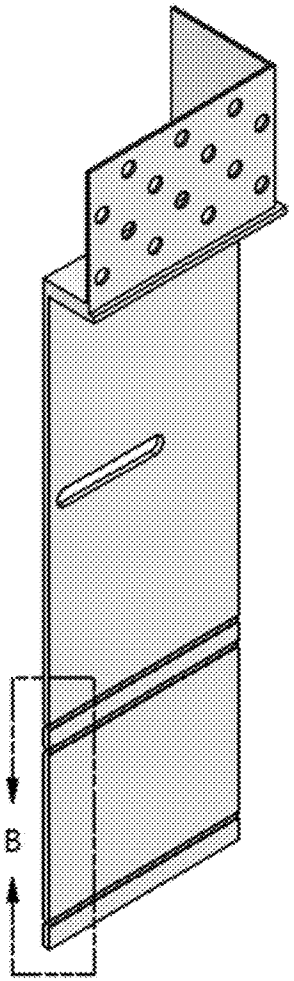
FIG. 55 shows a front isometric view of a corner baseboard reglet having a sharp corner for installation adjacent to a doorjamb, according to one implementation.
Figure 64:
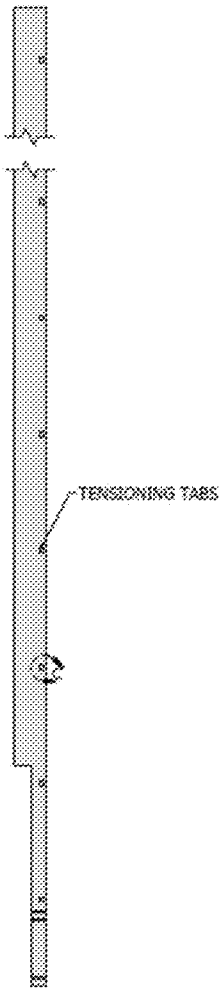
FIG. 64 shows another side view of the corner baseboard reglet of the system of FIG. 61.
Figure 63:
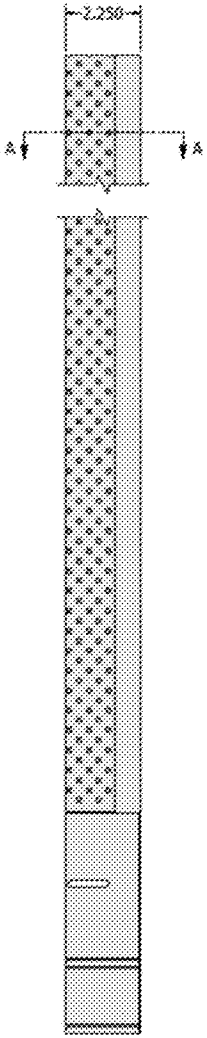
FIG. 63 shows a front view of the corner baseboard reglet of the system of FIG. 61.
Figure 62:
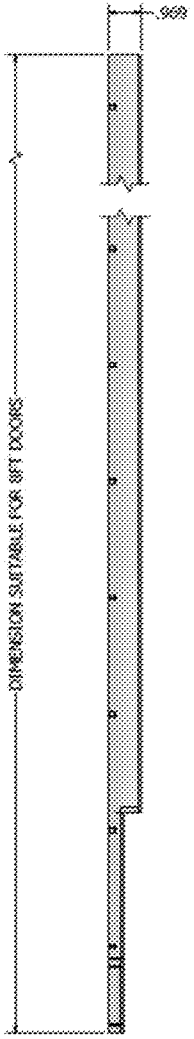
FIG. 62 shows a side view of the corner baseboard reglet of the system of FIG. 61.
Figure 61:
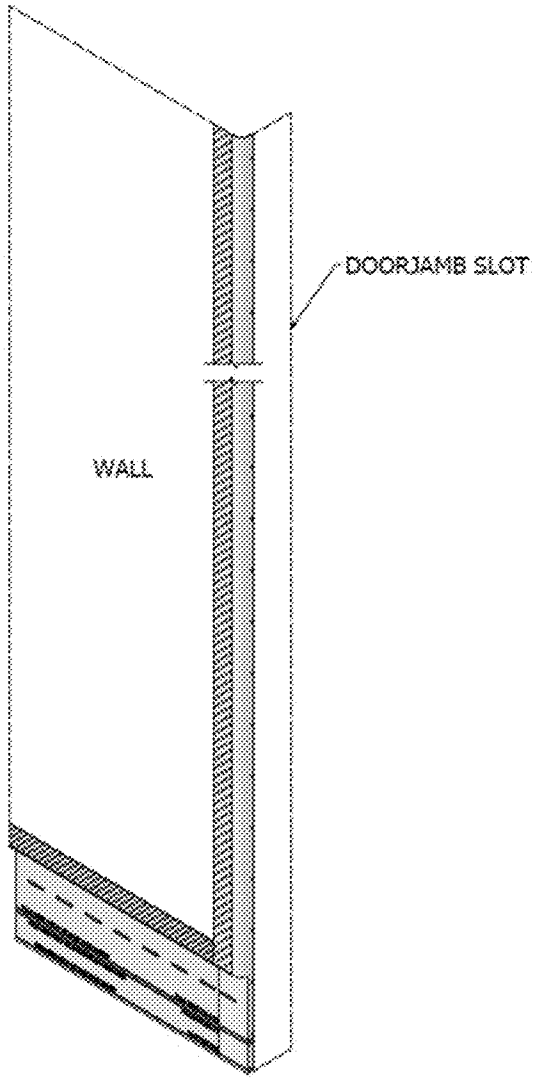
FIG. 61 shows an isometric view of a system including a ceiling-extended corner baseboard reglet installed with a straight run baseboard reglet, according to one implementation.

FIGS. 61-72 show various implementations of the corner baseboard reglets (e.g., the reglets shown in FIGS. 19, 38, and/or 55) with a modification to extend the vertical face (or mud flange with the rounded corner) upwards from the backbone along the corner of the wall (e.g., up to the ceiling or up to a head/top casing of a doorjamb). At least the curved portion of the mud flange of the corner baseboard reglet of FIG. 61 extends upward from the backbone for several feet (e.g., 6 feet to 8 feet and up to a ceiling surface) versus 1 inch to 2 inches as shown in FIG. 38. The circumference of the curved portion of the mud flange is reduced for the extended upper portion as compared to the lower portion.

Figure 65:
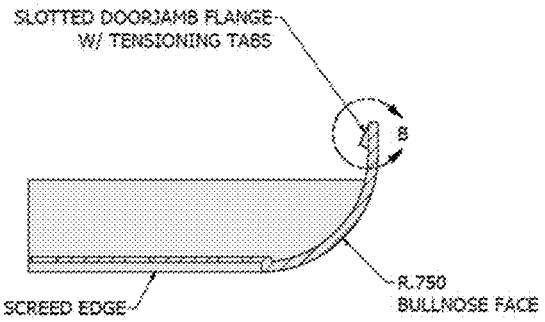
FIG. 65 shows a cross section of the corner baseboard reglet along line AA in FIG. 63.
Figure 66:
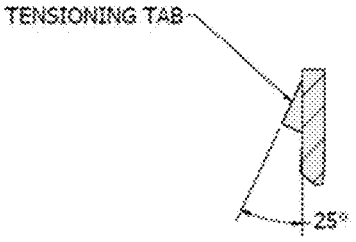
FIG. 66 shows a detail view of FIG. 65 showing the tensioning tab.
Figure 67:
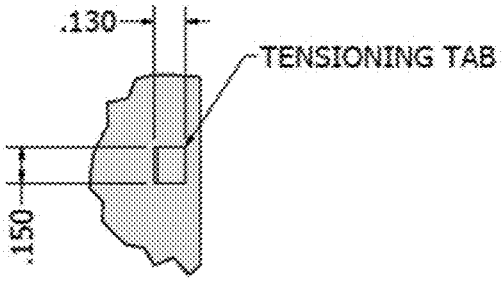
FIG. 67 shows a detail view of FIG. 65 showing another view of the tensioning tab.
Figure 69:
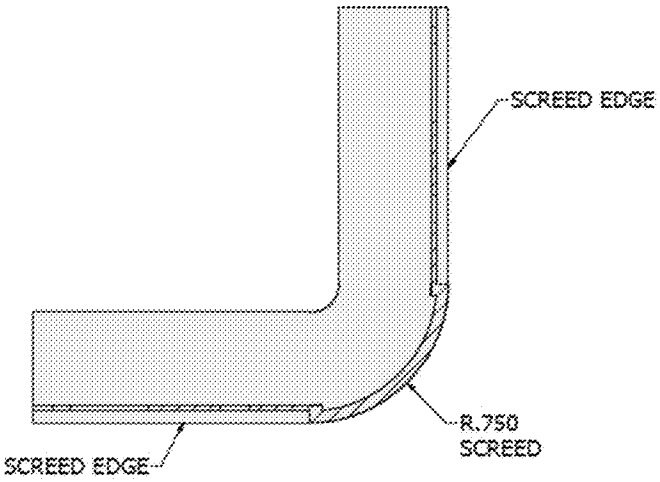
FIG. 69 shows a top view of the reglet of the system of FIG. 68.
Figure 68:
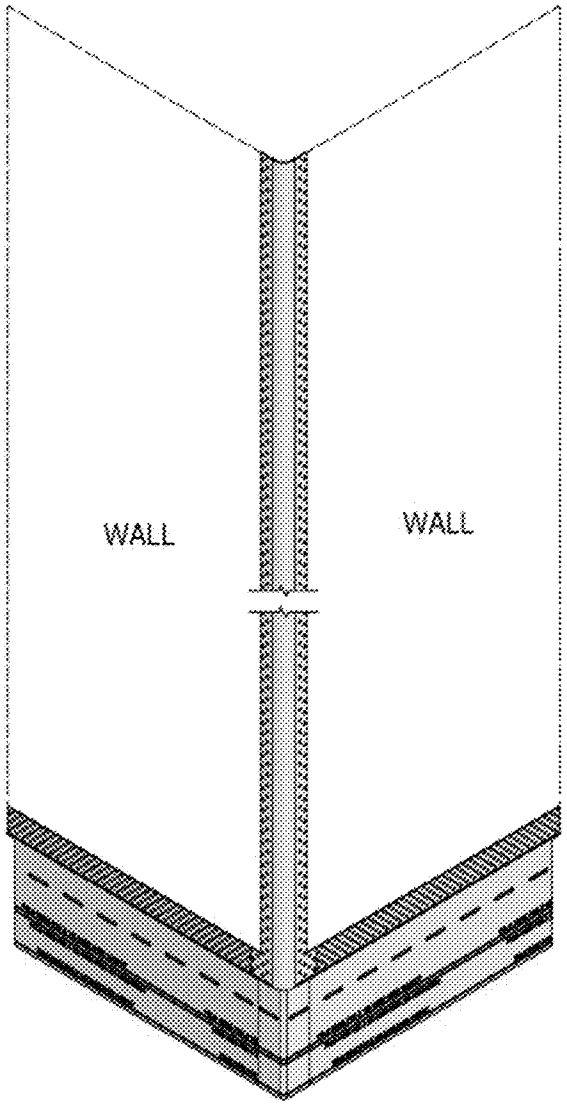
FIG. 68 shows an isometric view of a system including a ceiling-extended corner baseboard reglet installed with two straight run baseboard reglets-one on either side of the reglet on adjacent walls, according to one implementation.
Figure 72:
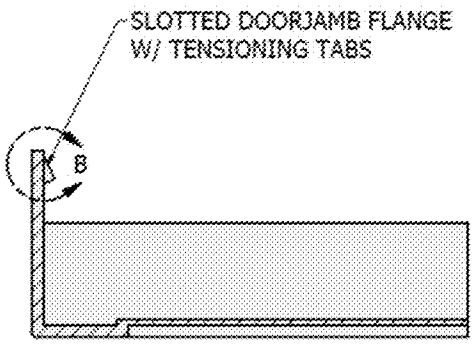
FIG. 72 shows a cross section along line AA in FIG. 71.
Figure 71:
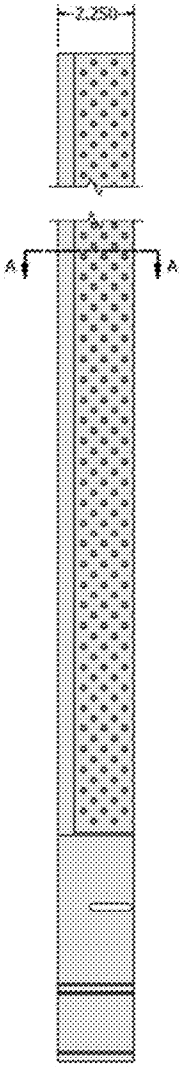
FIG. 71 shows a front view of the corner baseboard reglet of the system of FIG. 70.
Figure 70:
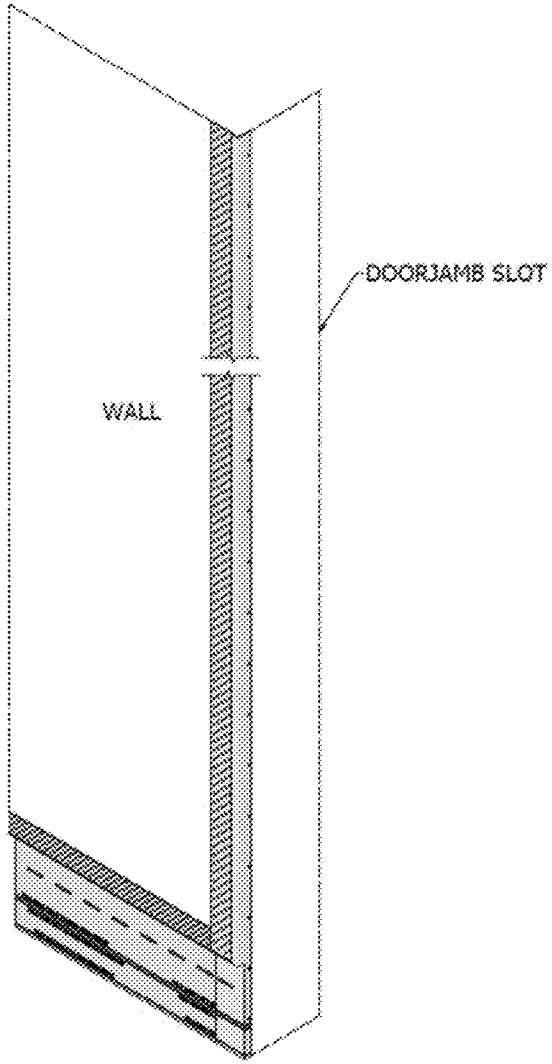
FIG. 70 shows an isometric view of a system including a ceiling-extended corner baseboard reglet having a sharp corner installed with a straight run baseboard reglet, according to one implementation.
Figure 75:
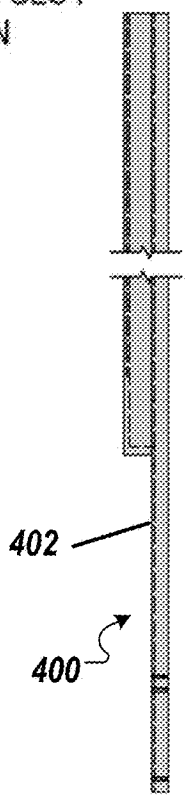
FIG. 75 shows a side view of the doorjamb reglet of FIG. 73.
Figure 74:
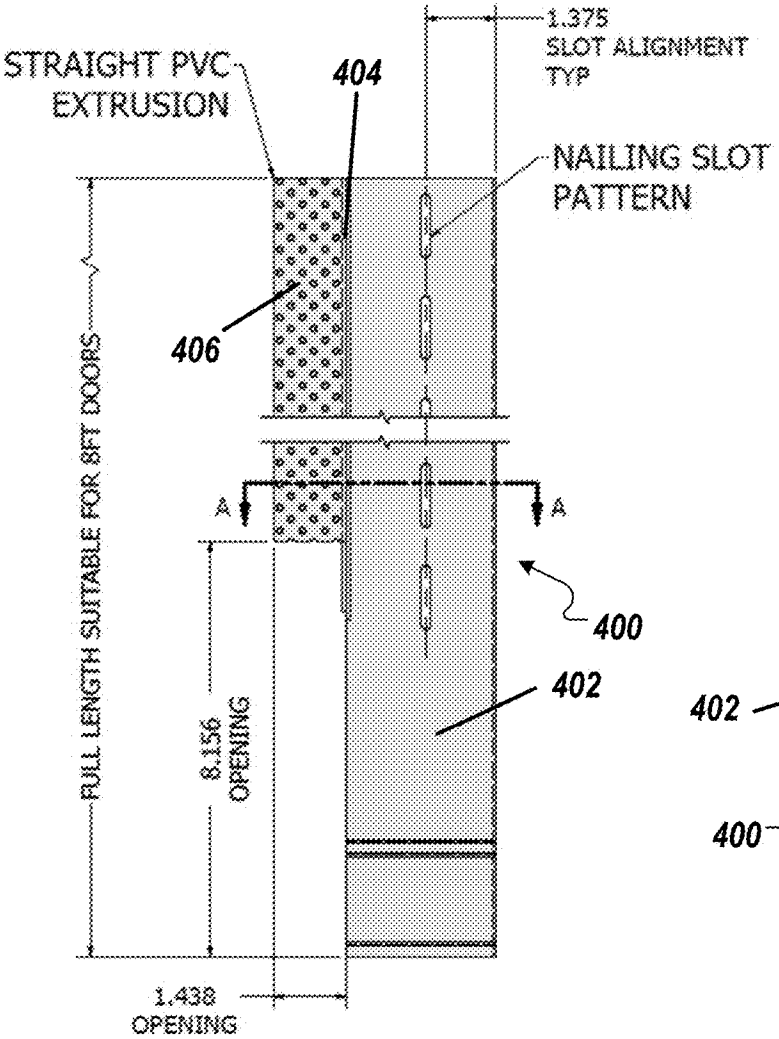
FIG. 74 shows a front view of the doorjamb reglet of FIG. 73.

Each of the reglets of FIGS. 61-72 provide a similar structure and function for a variety of implementations. For example, FIGS. 61-67 provide a corner baseboard reglet with a rounded corner configured to abut a doorjamb and extend all the way to the ceiling (or, in some implementations, to the head/top casing of the doorjamb). A variety of sizes and aesthetic implementations are also provided (e.g., bullnose corners with ½ inch or ¾ inch radius of curvature, or sharp corner reglets). In some implementations, the doorjamb-adjacent baseboard reglet includes tensioning tabs disposed on the slotted doorjamb flange. For example, as shown in FIGS. 65-67, tensioning tabs are disposed on the slotted doorjamb flange in an alternating pattern from the floor to the ceiling. The tensioning tabs are configured to abut an inner wall surface within the doorjamb slot (e.g., a stud adjacent to the door jamb) to keep the upward extension of the baseboard reglet in place along the height of the mud flange.

Doorjamb Reglet

Figure 73:
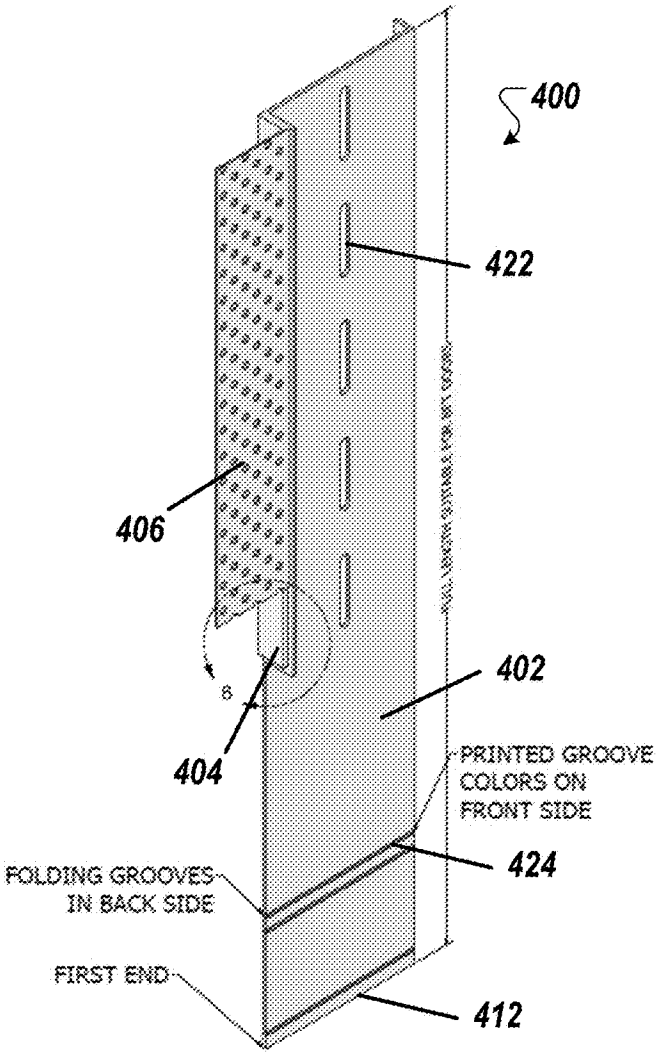
FIG. 73 shows an isometric view of a doorjamb reglet, according to one implementation.
Figure 76:
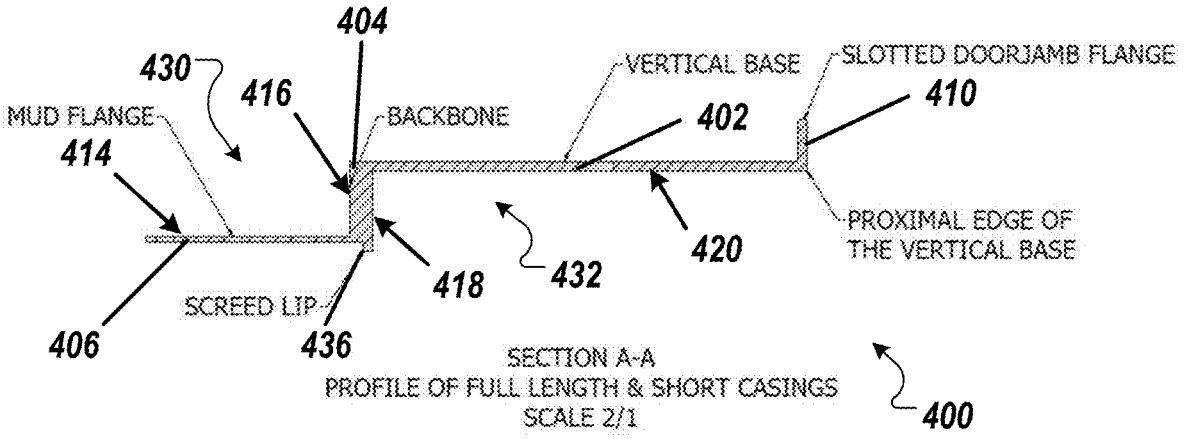
FIG. 76 shows a cross section of the doorjamb reglet along line AA in FIG. 74.
Figure 77:
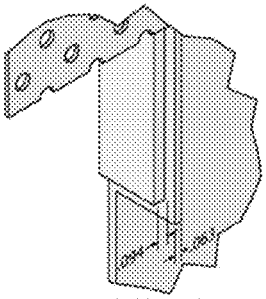
FIG. 77 shows a detail view of the backbone of the doorjamb reglet of FIG. 73.
Figure 78:
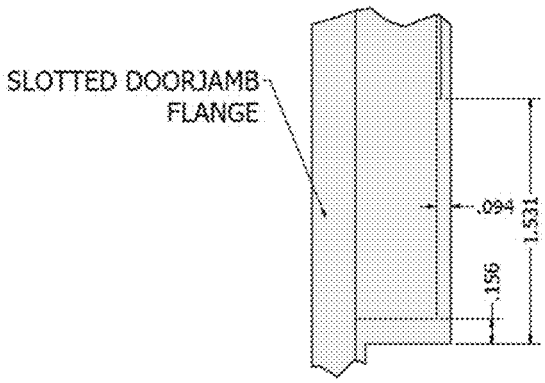
FIG. 78 shows another detailed planar view of the backbone of the doorjamb reglet of FIG. 73.

FIGS. 73-78 show an alternative implementation of a reglet configured for accepting a doorjamb trim piece. In contrast to the doorjamb-adjacent corner baseboard reglets of FIG. 19, which provide a cavity for installing a recessed baseboard trim piece adjacent to a doorjamb, the doorjamb reglets of FIGS. 73-78 provide a cavity for installing a recessed doorjamb trim piece vertically against a door frame. For example, FIG. 73 shows a doorjamb reglet 400 for installing a recessed doorjamb trim piece on the left side of a door frame. However, it is understood that a similar reglet for a right side of a door frame is contemplated by this disclosure.

The doorjamb reglet 400 includes a base 402, a backbone 404, a mud flange 406, and a slotted doorjamb flange 410. The base 402, backbone 404, and mud flange 406 of the doorjamb reglet 400 are arranged similarly to the base, backbone, and mud flange of the straight baseboard reglet 100 shown in FIG. 1. However, the basic orientation of the structure is flipped 90 degrees.

The base 402 of the doorjamb reglet 400 extends in a first plane parallel to a wall surface when installed. A bottom edge 412 of the base 402 abuts the floor and may be folded along a fold groove 424 to form a foot. The fold grooves 424 are similarly arranged as, and function similarly to, the fold grooves of the baseboard reglets described above such that, when folded, a foot is formed parallel to the floor surface.

The backbone 404 is integrally formed with and extends from the base 402 in a second plane that is substantially perpendicular to the first plane. The mud flange 406 is integrally formed with and extends from the backbone 404 in a third plane that is substantially perpendicular to the second plane. The third plane is substantially parallel to and spaced apart from the first plane.

A back surface 414 of the mud flange 406 and a first surface 416 of the backbone 404 together define a first cavity 430 configured to accept a drywall panel. A second surface 418 of the backbone 404 and a front surface 420 of the base 402 define a second cavity 432 configured to accept a doorjamb trim piece.

The slotted doorjamb flange 410 is integrally formed with and extends from the bottom edge 412 of the base 402 opposite from the backbone 404. The slotted doorjamb flange 410 extends in a fourth plane that is substantially perpendicular to the first plane and substantially parallel to and spaced apart from the second plane.

The base 402 of the doorjamb reglet 400 further defines a pattern of nail slots 422. A center of each nail slot is placed roughly halfway between the bottom edge 412 of the base 402 and the backbone 404. The nail slots are spaced apart from each other along a longitudinal axis of the doorjamb reglet by 1 inch to 6 inches (e.g., 2.25 inches) as measured from the end of one slot to the end of the next adjacent slot. The nail slots 422 are arranged along a longitudinal axis of the base 402 that is perpendicular to the floor surface when installed. The nail slots 422 are provided, in part, to allow a user to identify locations for nailing the doorjamb reglet into the wall frame (e.g., framing studs).

When installed, the slotted doorjamb flange 410 extends back into the wall surface. The slotted doorjamb flange 410 is configured to be installed in a slot adjacent to the door frame to further align and secure the doorjamb reglet 400 in place.

When installed, the backbone 404 extends away from the wall surface and is perpendicular to both the floor surface and the wall surface. The doorjamb cavity 432 defined by second surface 418 of the backbone 404 and the front surface 420 of the base 402 is configured to accept a doorjamb trim piece for installation.

The backbone includes a screed lip 436 extending out from the second surface 418 of the backbone 404 in a plane parallel to that of the backbone 404. The screed lip 436 is similar in structure and operation to the screed lip of the baseboard reglet described above in relation to FIG. 1.

The installation and operation of the doorjamb reglet 400 is similar to that of the baseboard reglet elsewhere described. First, a drywall panel is installed to a desired height from the floor. Then, a fold groove 424 on the first end of the doorjamb reglet 400 is selected and folded to create a foot extending out from the base to be parallel to the floor surface. The slotted doorjamb flange 410 is inserted into a slot between the doorjamb and an adjacent structural member (e.g., a framing stud). At the same time, the mud flange 406 is placed over the drywall panel such that the drywall cavity 430 receives the drywall panel. Nails are then driven through the nail slots 422 in the vertical base 402 to secure the doorjamb reglet 400 in place. A doorjamb trim piece is then installed within the doorjamb cavity 432 (e.g., with or without a gap reveal adjacent the proximal surface of the backbone). Then, mud or joint compound is spread over the drywall panel and the mud flange 406 over to the screed lip 436.

The resulting arrangement is a recessed doorjamb trim piece with a flush surface extending from the doorjamb trim to the drywall panel. In some implementations, a gap reveal is included.

Figure 79:
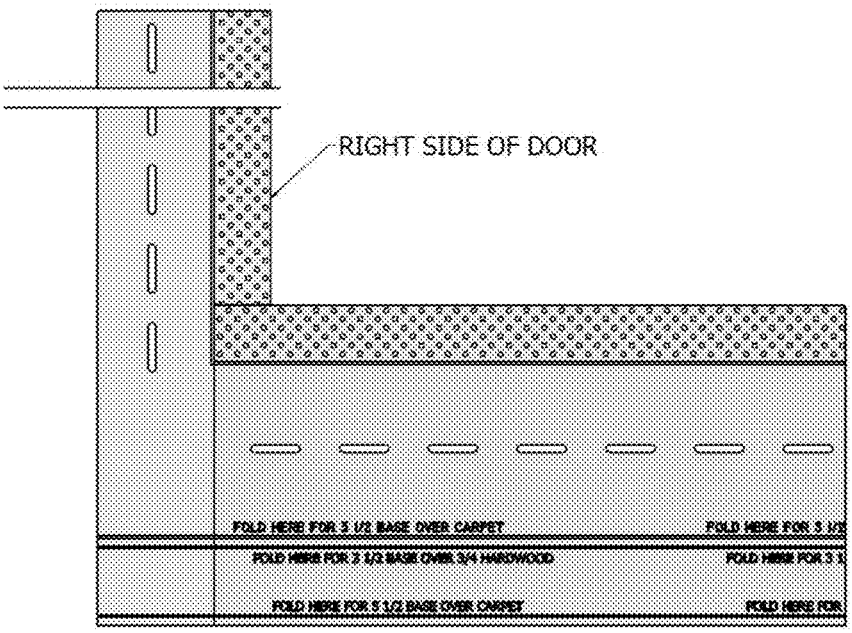
FIG. 79 shows a system of a doorjamb reglet installed with straight run baseboard reglet for the right side of a door, according to one implementation.
Figure 80:
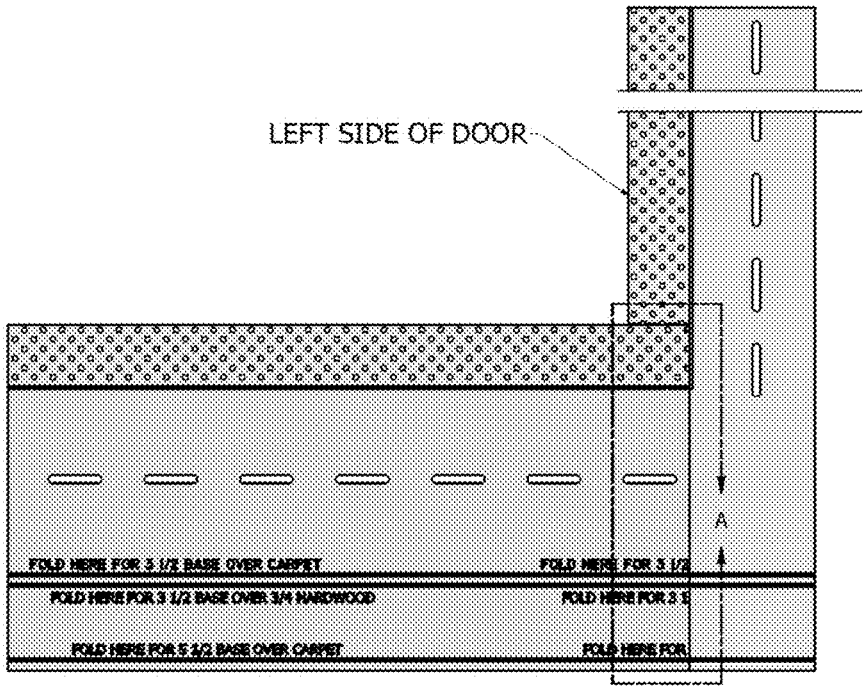
FIG. 80 shows a system of a doorjamb reglet installed with straight run baseboard reglet for the left side of a door, according to one implementation.
Figure 81:
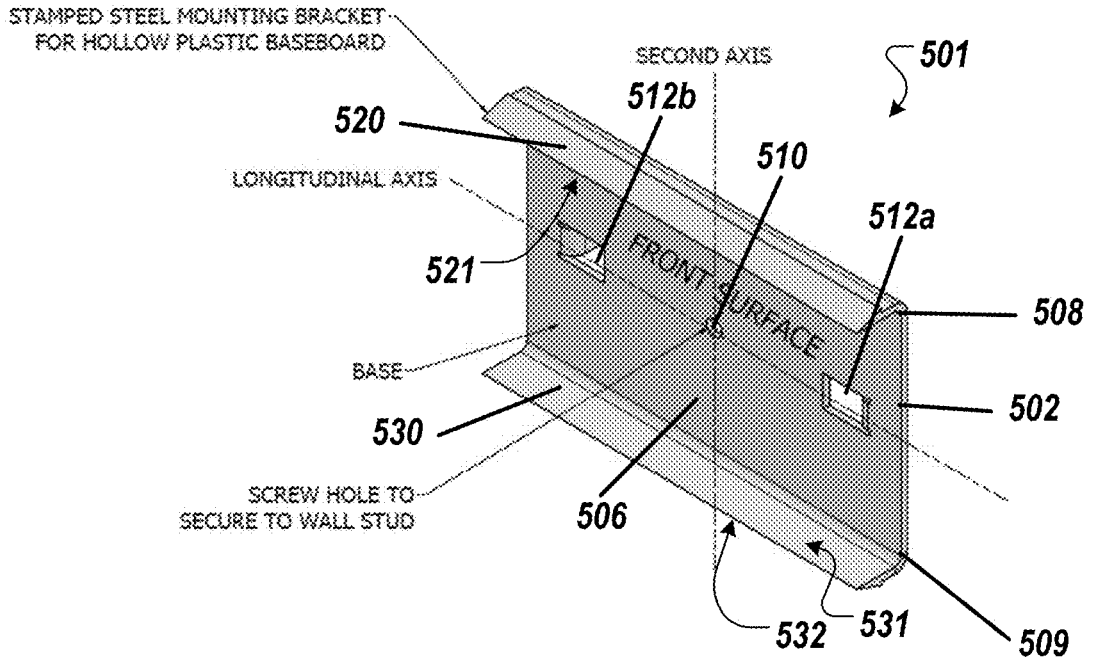
FIG. 81 shows an isometric view of the front side of a mounting bracket for clip-on baseboard systems, according to one implementation.
Figure 82:
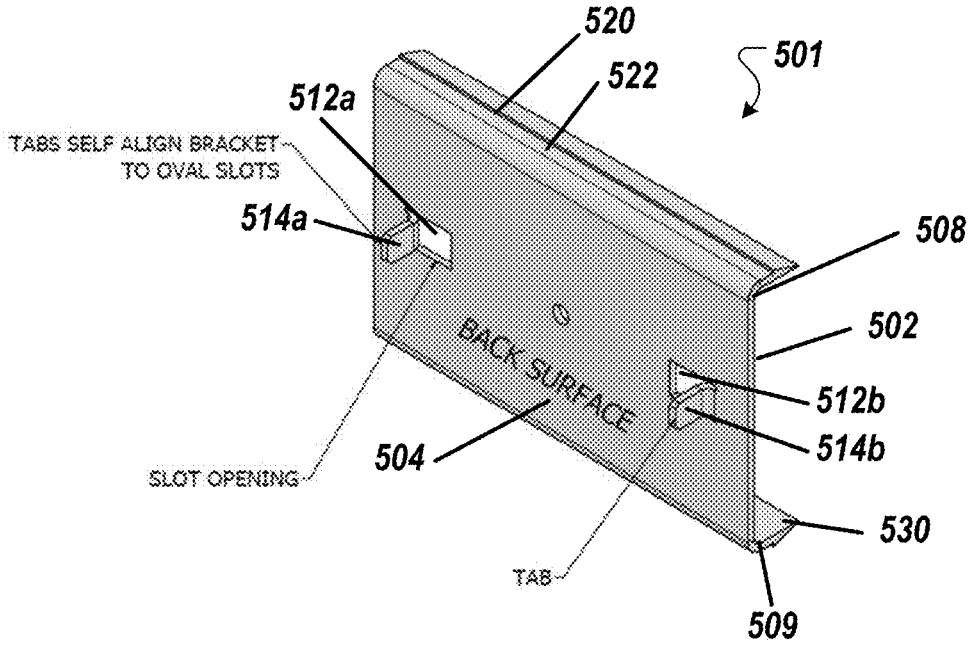
FIG. 82 shows an isometric view of the back side of the mounting bracket of FIG. 81.
Figure 84:
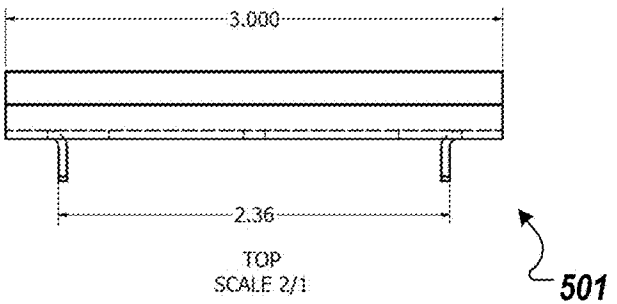
FIG. 84 shows a top view of the mounting bracket of FIG. 81.
Figure 86:
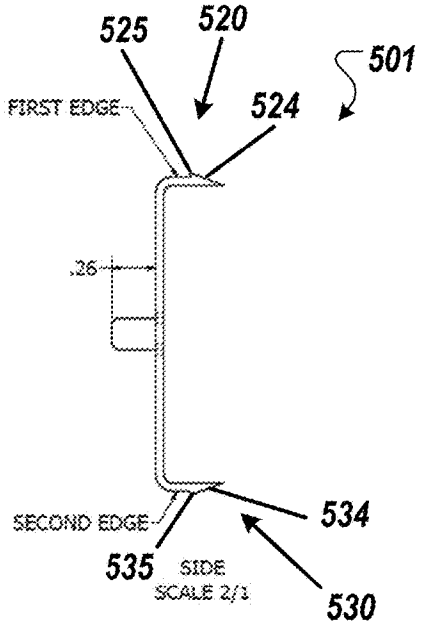
FIG. 86 shows a side view of the mounting bracket of FIG. 81.
Figure 85:
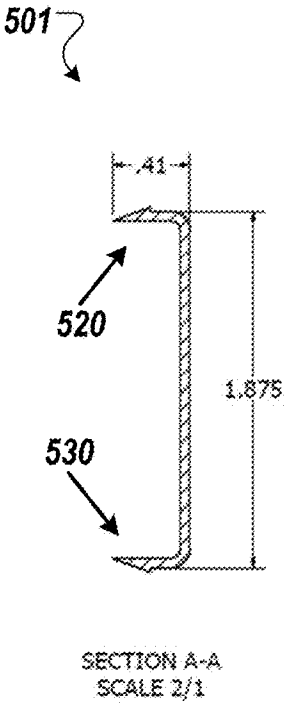
FIG. 85 shows a cross section along line AA in FIG. 83.
Figure 83:
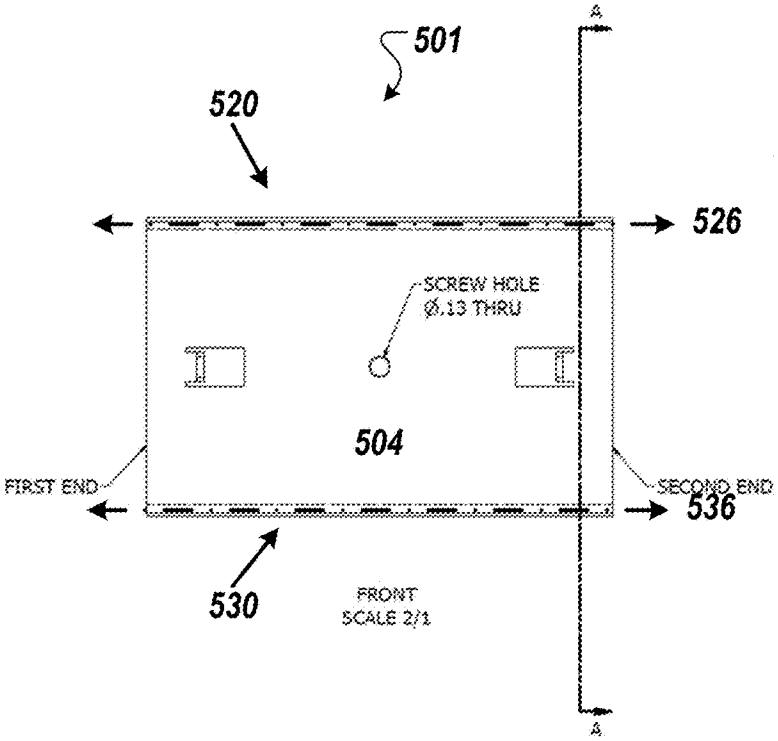
FIG. 83 shows a planar view of the back surface of the mounting bracket of FIG. 81.
Figure 87:
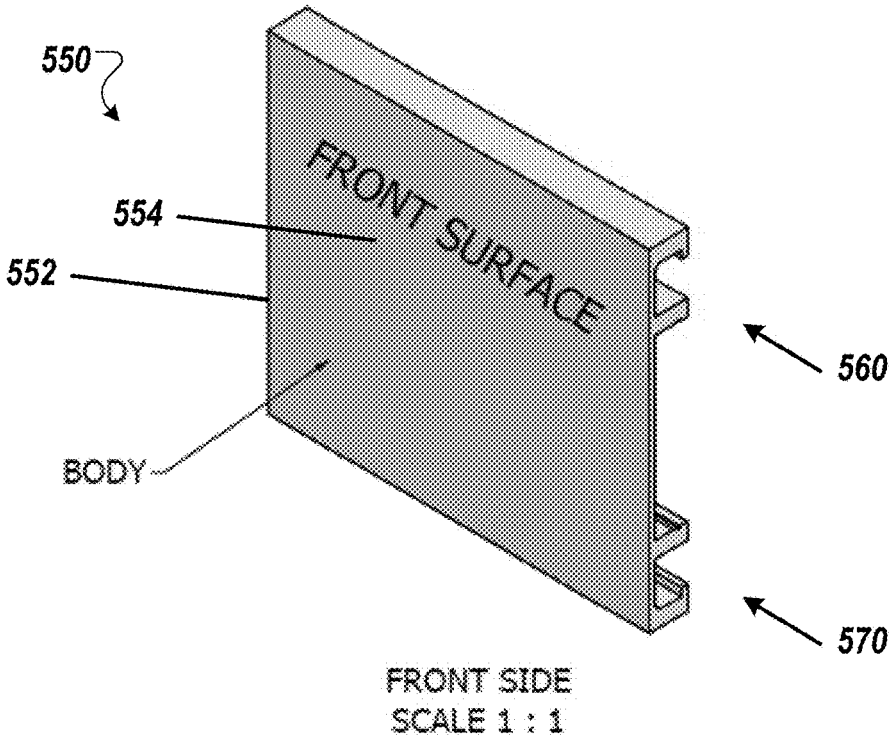
FIG. 87 shows a front isometric view of a hollow baseboard, according to one implementation.
Figure 88:
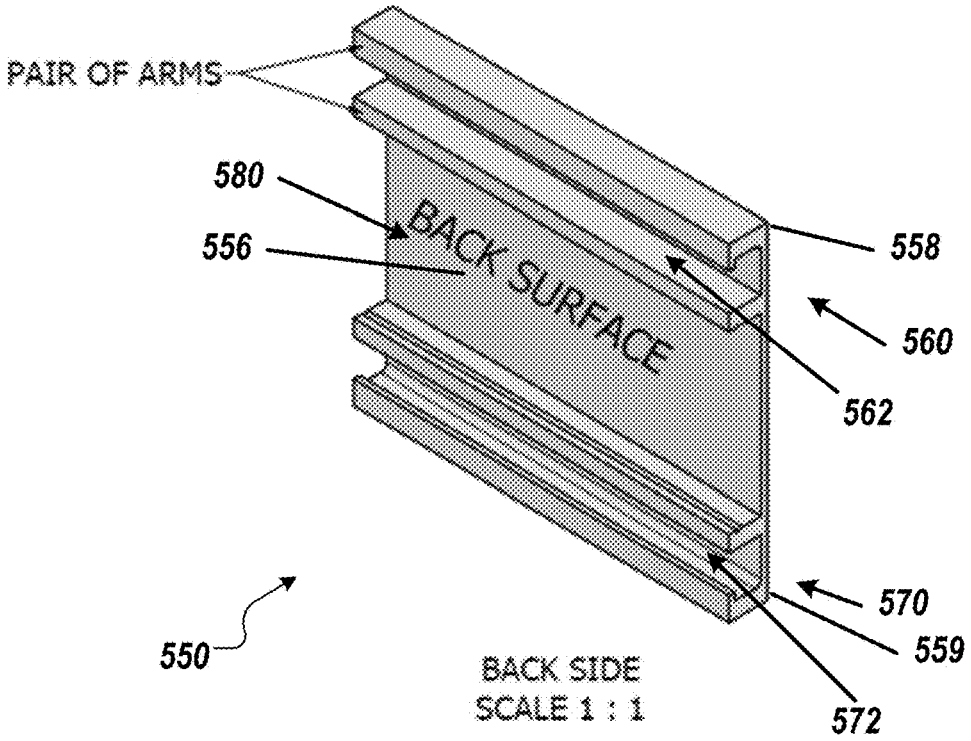
FIG. 88 shows a back isometric view of the hollow baseboard of FIG. 87.
Figure 90:
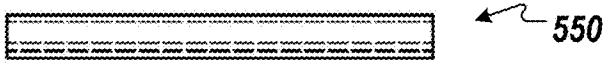
FIG. 90 shows a top view of the hollow baseboard of FIG. 87.
Figure 92:
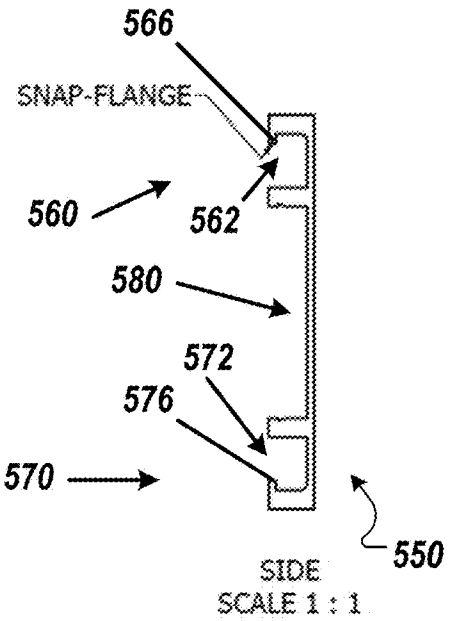
FIG. 92 shows a side view of the hollow baseboard of FIG. 87.
Figure 91:
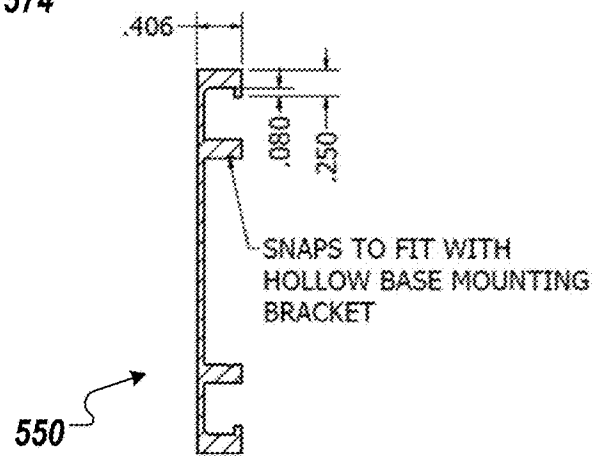
FIG. 91 shows a cross section along line AA of FIG. 89.
Figure 89:
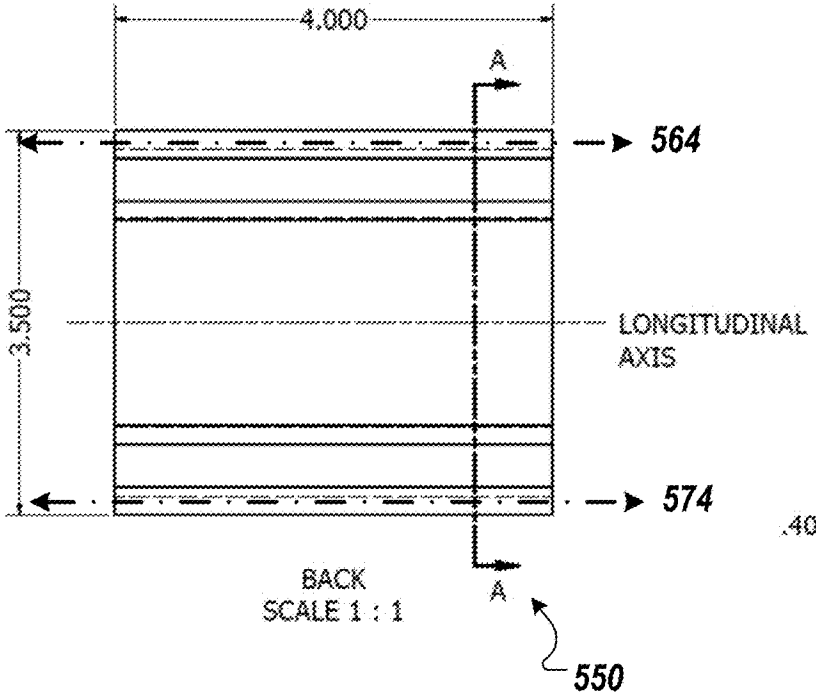
FIG. 89 shows a planar view of the back surface of the hollow baseboard of FIG. 87.
Figure 93:
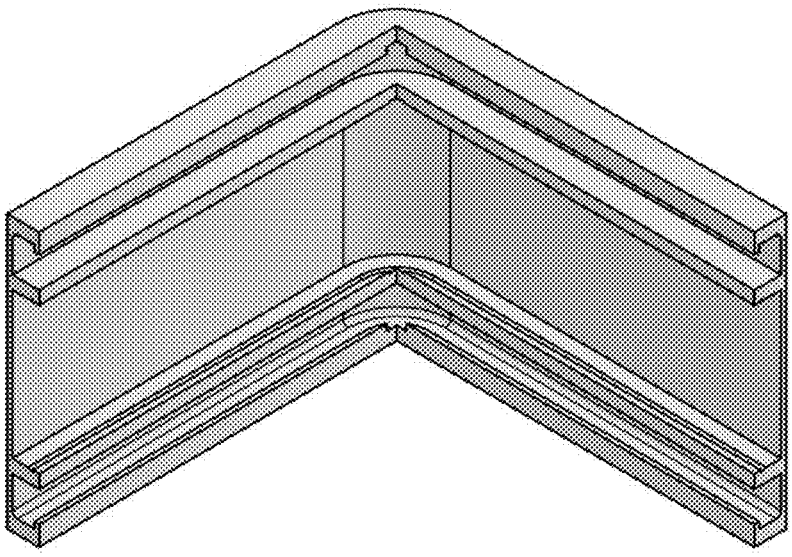
FIG. 93 shows a back isometric view of a corner hollow baseboard, according to one implementation.
Figure 94:
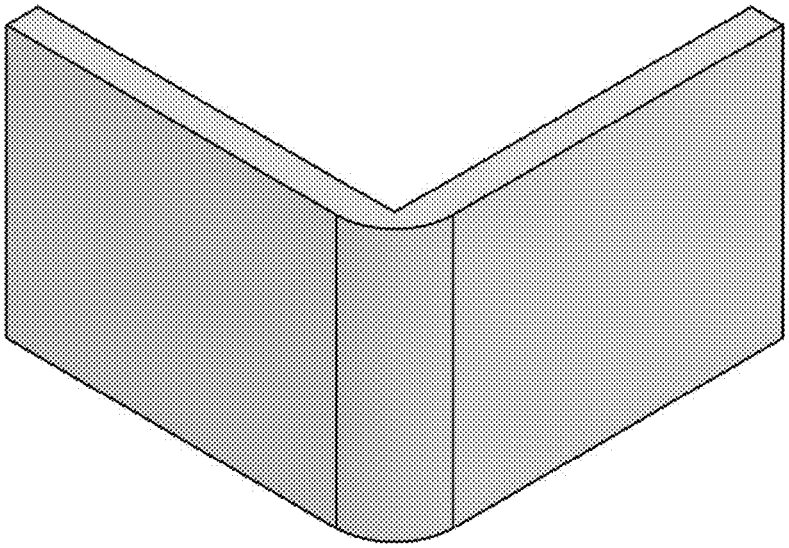
FIG. 94 shows a front isometric view of the corner hollow baseboard of FIG. 93.
Figure 97:
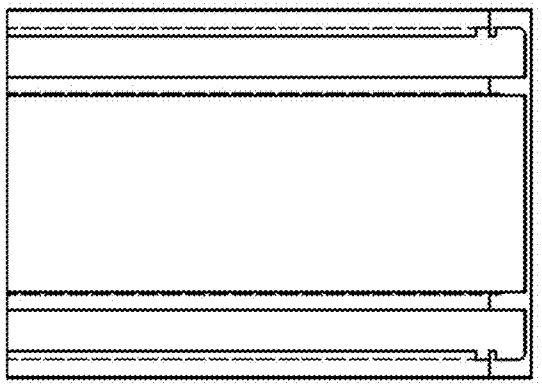
FIG. 97 shows a side view of the corner hollow baseboard of FIG. 93.
Figure 98:
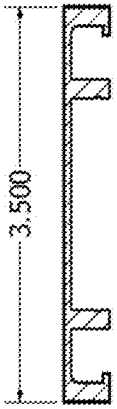
FIG. 98 shows a cross section through line AA of FIG. 96.
Figure 95:
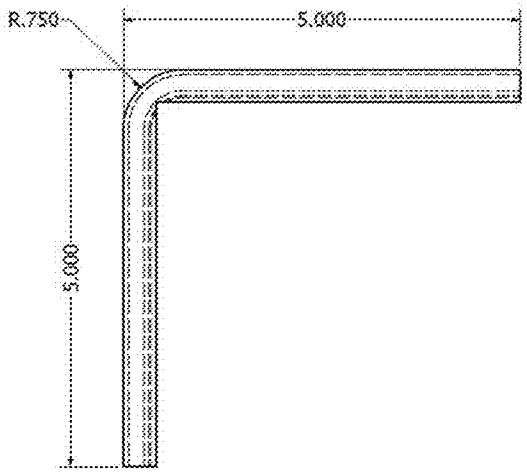
FIG. 95 shows a top view of the corner hollow baseboard of FIG. 93.
Figure 96:
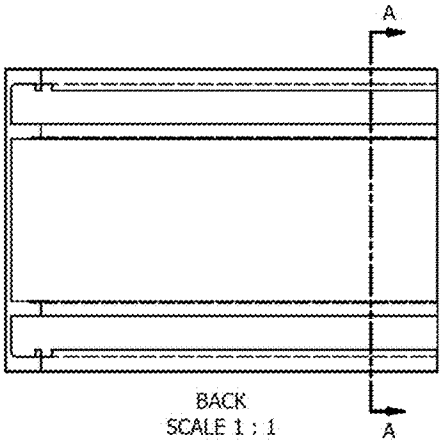
FIG. 96 shows a back planar view of the corner hollow baseboard of FIG. 93.

The baseboard reglet and the doorjamb reglet of the above examples may be installed with each other to form a continuous inset trim system around a door. For example, FIGS. 79-80 show a system having a left- and right-side doorjamb reglet installed with a straight piece of baseboard reglet underneath. The system allows for the installation of recessed baseboard and doorjambs in a single arrangement, creating a continuous flush surface.

In some examples, a kit or package is disclosed containing: a left-side doorjamb reglet, a right-side doorjamb reglet, a left-side baseboard reglet, a right-side baseboard reglet, and a top-side doorjamb reglet. Such a kit or package allows for ready-to-install flush trim system.

Clip-on Baseboard System

FIGS. 81-100 show a clip-on baseboard system, which is compatible with the baseboard reglet of this disclosure to form a recessed baseboard arrangement. FIGS. 81-86 show a mounting bracket 501 of the clip-on baseboard system. The mounting bracket 501 includes a base 502 extending in a plane parallel to a wall surface when installed. The base 502 includes a back surface 504 and a front surface 506. The front surface 506 of the mounting bracket 501 includes a first edge 508 and a second edge 509 opposite and spaced apart from the first edge 508.

The base defines a center hole 510 defined by the base 502 and located approximately at the midpoint of the front surface 506. The center hole 510 is used to install the mounting bracket 501 to a framing stud and/or a baseboard reglet via a screw or other fastener. The base 502 further defines two slot openings 512*a*, 512*b* spaced apart from each other on either side of the center hole 510. Each slot opening 512*a*, 512*b* may be formed by cutting out and bending a tab 514*a*, 514*b* from the base. Thus, the base includes two tabs 514*a*, 514*b* extending out from the back surface 504 of the base 502 when installed.

The mounting bracket 501 further includes a first clip 520 and a second clip 530 each extending from the first edge 508 and the second edge 509 of the base 502, respectively. The first and second clips 520, 530 (or first and second clip members) extend outwardly from the front surface 506 of the base 502 when installed. Thus, the clips 520, 530 extend in a direction opposite of the direction of the tabs 514*a*, 514*b*. The first clip 520 includes an inner surface 521 facing an opposite inner surface 531 of the second clip 530.

Each clip 520, 530 includes an outer surface 522, 532 opposite from the inner surfaces 521, 531, each of the outer surfaces 522, 532 facing away from each other. The outer surfaces 522, 532 define a ramped surface 524, 534 and a shoulder 525, 535. The ramped surface 524, 534 of each clip 520, 530 extends along the outer surface 522, 532 from the shoulder 525, 535 to form a snap-fit arrangement. A first longitudinal axis 526 is associated with each the first clip member 520, and a second longitudinal axis 536 is associated with each the second clip member 530. The first and second longitudinal axes 526, 536 are parallel to each other.

FIGS. 87-92 shows a straight piece of a hollow clip-on baseboard 550. The hollow baseboard 550 includes a body 552 having a front surface 554 configured to be displayed outwardly when installed in a recessed baseboard system and a back surface 556 opposite the front surface 554. The hollow baseboard 550 includes four arms extending out from a back surface 556 of the body 552. The four arms include two pairs of corresponding arms each arranged on either side of the hollow baseboard (i.e., one pair of arms on a first or top side of the back surface and one pair on a second or bottom side of the back surface). The first pair of arms 560 extends from a first edge 558 of the back surface 556 to define a first cavity 562. The second pair of arms 570 extends from a second edge 559 of the back surface 556, which is opposite and spaced apart from the first edge 558, to define a second cavity 572.

A third longitudinal axis 564 is associated with each the first pair of arms 560, and a fourth longitudinal axis 574 is associated with each the second pair of arms 570. The third and fourth longitudinal axes 564, 574 are parallel to each other.

Each pair of arms 560, 570 includes a first arm that is substantially straight and a second arm having a snap-flange 566, 576 extending perpendicularly from the second arm towards the first arm. The bracket cavity 562, 572 of each pair of arms 560, 570 is configured to accept a respective clip 520, 530 of the mounting bracket 501. The second arms are flexible, which allows the ramped surface 524, 534 of the clip 520, 530 to slide along the second arm of clip-on baseboard 550 until the shoulder 525, 535 passes the snap-flange 566, 576—snapping the hollow baseboard 550 in place on the mounting bracket 501.

The space between the first arms of opposing pairs of arms 560, 570 defines an inner cavity 580. The inner cavity 580 may be used, for example, to run electrical or low-voltage lighting wires along the hollow baseboards 550.

Figure 99:
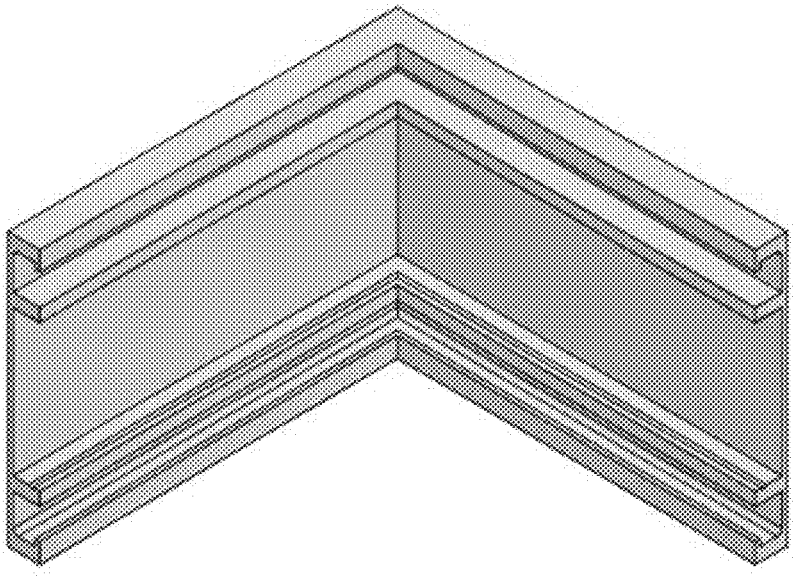
FIG. 99 shows a back isometric view of a corner hollow baseboard having a sharp corner, according to one implementation.
Figure 100:
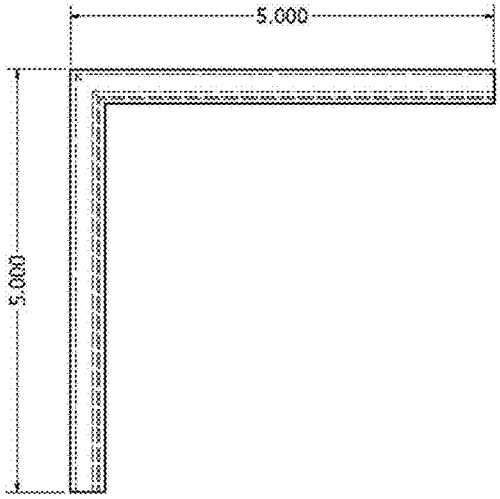
FIG. 100 shows a top view of the corner hollow baseboard of FIG. 99.

FIGS. 93-98 show implementations of the hollow baseboard forming an outside corner. The hollow baseboard in FIGS. 93-98 includes a rounded corner with a radius of curvature of ¾ inch; however, in other implementations, other dimensions are contemplated by this disclosure (e.g., a radius of curvature of ½ inch). FIGS. 99-100 show a sharp corner implementation of the same. Therefore, a combination of linear pieces and corner pieces can be used together to form a continuous clip-on baseboard system around a corner or other discontinuity in a wall.

Figure 101:
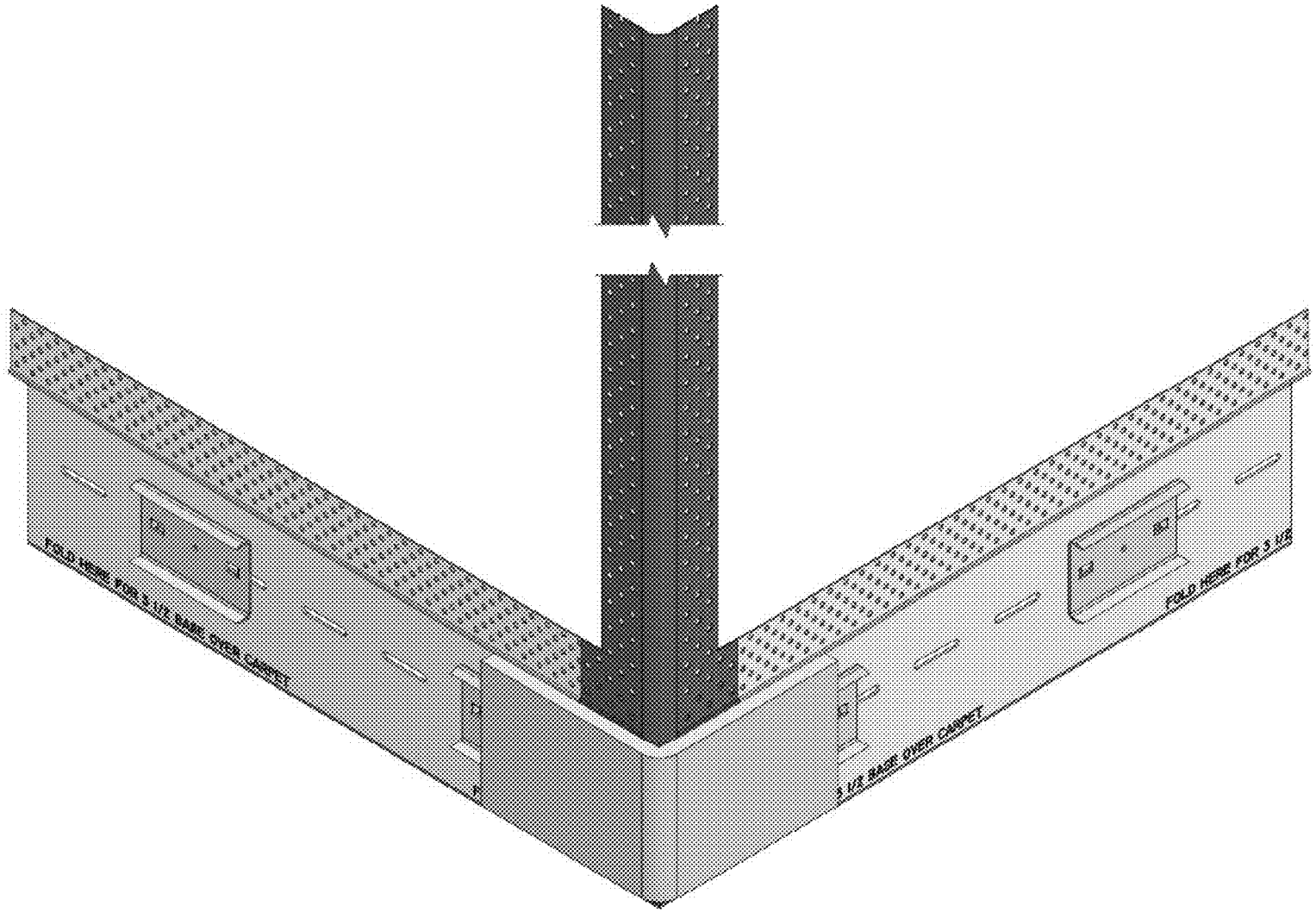
FIG. 101 shows a of a recessed baseboard system including the straight run baseboard reglet of FIG. 1, the corner baseboard reglet of FIG. 68, the mounting bracket of FIG. 81, and the corner hollow baseboard of FIG. 93, according to one implementation.

A clip-on baseboard system may be further implemented with the baseboard reglets and the doorjamb reglets described above. For example, FIG. 101 shows a combined system of each element installed on an outside corner—including the straight run baseboard reglet of FIG. 1, the corner baseboard reglet of FIG. 68, the mounting bracket of FIG. 81, and the corner hollow baseboard of FIG. 93. The resulting look, particularly for the bullnose or rounded baseboards, is a completely recessed clip-on baseboard system with a rounded corner from the floor to the ceiling (which may include a gap reveal).

Example Assembly Instructions for the Installation of Universal Straight Run Baseboards Using a Straight Baseboard Reglet (e.g., the Reglet of FIG. 1)

FIGS. 11-18 provide a set of step-by-step images of the installation process for an example straight reglet of this disclosure, the process of which may be applied to curved reglets as well.

Step #1. Before the installation process, a user decides on (i) the thickness of flooring to be installed, and (ii) the finished height of the baseboard trim. Using those two parameters, a desired height is determined for both drywall installation and baseboard reglet installation. Then, one or more drywall panels are installed on a wall (e.g., by nails extending through the drywall panel and into the studs). The drywall is installed to match the desired height (e.g., a lower edge of the drywall panels may be 4 inches above a ground/floor/sub-floor or other flat flooring surface).

Step #2. Once the drywall panels are installed, the baseboard reglet is installed by folding one of the desired fold grooves to form the foot. The example shown in FIGS. 11-13 show a selected finish height used for 3½ inches wood baseboard trim installed on top of ¾ inch thick hardwood flooring. Thus, the base is folded on the blue line that corresponds with a fold relief groove to form the foot. Printed and engraved along that line in the matching color is text that describes that anticipated height. Such labels may alternate languages every 12", but it is currently shown in English. The other colors represent other baseboard heights and flooring thicknesses and are printed in the corresponding colors. For example, if the desired height is a 5½ inches baseboard and a ¾ inch flooring thickness, then no folds are needed and the straight reglet can be used at full factory height sitting against the sub-floor or concrete floor on which the finished floor will be installed. The folded portion should remain attached until installation is complete to maintain a straighter path along the wall.

Step #3. Plan all installation of the full length straight baseboard reglets to start from an inside corner. As shown in FIG. 14, the first piece of straight baseboard reglet (e.g., a first baseboard reglet) to start from the corner needs only the first breakaway tab on the first end of the baseboard reglet removed by clipping or cutting along the engraved grooves. This allows the base and backbone to pass beneath the drywall and touch the wall stud in the corner. The next full-length piece of straight baseboard reglet (e.g., a second baseboard reglet of FIG. 15) to meet in that corner will have both breakaway tabs (e.g., the second breakaway tab on the second end of the reglet) removed by clipping or cutting along the engraved grooves of the tabs on the end that will contact the first reglet. This arrangement allows the second baseboard reglet to contact the first baseboard reglet along each of (i) the base and backbone beneath the drywall and (ii) the mud flange on the face of the drywall simultaneously. This connection sequence is illustrated in FIG. 16 and shown completed in FIG. 17.

Step #4. Attach the straight baseboard reglets with nails or screws starting from the corner connection and towards the center of the wall along which it runs. Nails or screws may be driven through the mud flange into a wall stud. Nails or screws can also be used through the nail slots in the base to assure a straight, flat path that keeps consistent contact with the sub-floor.

To start from an outside corner or a slotted corner reglet, use a corner baseboard reglet (e.g., the reglet shown in FIG. 19). To select a height on those baseboard reglets, a user first clips or cuts the vertical groove on the base from the backside to separate the two surfaces so they may be folded in the opposite directions as shown, creating two feet on opposing sides of the baseboard reglet. The component can now be attached vertically to the outside corner or the appropriate side of a slotted door jamb using nails or screws through the base. Keep the folds/feet tight to the subfloor and run straight vertically all the way to the ceiling if using the full-length component.

In the case of a slotted door installation, the slotted door corners will need to be cut at 45 degrees corresponding to the horizontal slot on the top jamb of the door. A short section of Slotted Door Jamb Corner will be installed across the top of the door. Miter at 45 degrees to fit both left and right sides to complete the mud flange around the entire door.

The construction and arrangement of the systems and methods as shown in the various implementations are illustrative only. Although only a few implementations have been described in detail in this disclosure, many modifications are possible (e.g., variations in sizes, dimensions, structures, shapes, and proportions of the various elements, values of parameters, mounting arrangements, use of materials, colors, orientations, etc.). For example, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative implementations. Other substitutions, modifications, changes, and omissions may be made in the design, operating conditions, and arrangement of the implementations without departing from the scope of the present disclosure.

It is to be understood that the methods and systems are not limited to specific synthetic methods, specific components, or to particular compositions. It is also to be understood that the terminology used herein is for the purpose of describing particular implementations only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another implementation includes from the one particular value and/or to the other particular value. Similarly, when values are expressed as approximations, by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal implementation. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific implementation or combination of implementations of the disclosed methods.

What is claimed is:

1. A reglet for forming an inset baseboard system at a corner, the reglet comprising:

a first side comprising:

a first base extending in a first plane;

a first backbone integrally formed with and extending from the first base in a second plane that is substantially perpendicular to the first plane such that the first base extends from a first end of the first backbone in a first direction; and a first mud flange integrally formed with and extending from the first backbone in a third plane that is substantially perpendicular to the second plane and substantially parallel to and spaced apart from the first plane, such that the first mud flange extends from a second end of the first backbone in a second direction that is opposite from the first direction, wherein a back surface of the first mud flange and a first surface of the first backbone together define a first drywall cavity configured to receive a drywall panel, and wherein a front surface of the first base and a second surface of the first backbone opposite of the first surface of the first backbone together define a first baseboard cavity configured to receive a baseboard section; and a second side forming an angle of between 0 and 180 degrees with the first side of the reglet, wherein the first side and the second side of the reglet are integrally formed to meet at a corner.

2. The reglet of claim 1, wherein the second side comprises:

a slotted doorjamb flange extending from a top end to a bottom end of the reglet in a fourth plane that is substantially perpendicular to each of the first plane and the second plane such that the first base and the slotted doorjamb flange intersect at a substantially right angle.

3. The reglet of claim 2, wherein the corner is a rounded corner and a curved portion having a radius of curvature is formed between the first mud flange and the slotted doorjamb flange.

4. The reglet of claim 2, wherein the slotted doorjamb flange comprises a tensioning tab extending from a back surface of the slotted doorjamb flange with an angle configured to abut a surface of a doorjamb to hold the reglet in place.

5. The reglet of claim 1, wherein the second side comprises:

a second base extending in a fourth plane;

a second backbone integrally formed with and extending from the second base in the second plane; and a second mud flange integrally formed with and extending from the second backbone in a fifth plane that is substantially perpendicular to the second plane and substantially parallel to and spaced apart from the fourth plane, wherein a back surface of the second mud flange and a first surface of the second backbone together define a second drywall cavity configured to receive a drywall panel, the second drywall cavity being in communication with the first drywall cavity, and wherein a front surface of the second base and a second surface of the second backbone opposite of the first surface of the second backbone together define a second baseboard cavity configured to receive a baseboard section, the second baseboard cavity being in communication with the first baseboard cavity.

6. The reglet of claim 5, wherein the first plane is orthogonal to the fourth plane, and the third plane is orthogonal to the fourth plane.

7. The reglet of claim 1, wherein the corner is a rounded corner.

8. The reglet of claim 1, wherein the corner defines a corner edge between the first side and the second side of the reglet.

9. The reglet of claim 1, wherein the first base defines a plurality of nail slots that are spaced apart from a bottom edge of the first base.

10. The reglet of claim 1, wherein the first base defines a plurality of fold grooves on a back surface of the first base, the plurality of fold grooves being parallel to and spaced apart from a bottom edge of the first base.

11. The reglet of claim 1, wherein the first mud flange defines a plurality of perforations configured to facilitate adherence of a joint compound therethrough.

12. The reglet of claim 1, wherein the first backbone further comprises a screed lip extending out from the first mud flange in a direction away from the first and third planes.

13. The reglet of claim 1, further comprising at least one breakaway tab formed by a portion of the first mud flange on a lateral edge of the reglet, the at least one breakaway tab being removable from the reglet to accommodate a second reglet installed adjacent to the reglet.

14. An inset baseboard system comprising:

the reglet of claim 1;

a drywall panel; and a baseboard, wherein a front surface of the baseboard is disposed in the third plane, and a top edge of the baseboard is spaced apart from a bottom surface of the first backbone to define a gap therebetween, wherein a bottom edge of the drywall panel is disposed between a back surface of the first mud flange and a top surface of the first backbone.

* * * * *